US010066368B2

(12) United States Patent
Hijikata et al.

(10) Patent No.: US 10,066,368 B2
(45) Date of Patent: Sep. 4, 2018

(54) HYDRAULIC FLUID ENERGY RECOVERY APPARATUS FOR WORK MACHINE

(71) Applicant: HITACHI CONSTRUCTION MACHINERY CO., LTD., Tokyo (JP)

(72) Inventors: Seiji Hijikata, Tsukuba (JP); Hidetoshi Satake, Ishioka (JP); Shinya Imura, Toride (JP); Shinji Nishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 460 days.

(21) Appl. No.: 14/761,384

(22) PCT Filed: Jan. 16, 2014

(86) PCT No.: PCT/JP2014/050718

§ 371 (c)(1),
(2) Date: Jul. 16, 2015

(87) PCT Pub. No.: WO2014/112566

PCT Pub. Date: Jul. 24, 2014

(65) Prior Publication Data

US 2015/0354172 A1 Dec. 10, 2015

(30) Foreign Application Priority Data

Jan. 17, 2013 (JP) ..... 2013-006202

(51) Int. Cl.
*F15B 11/024* (2006.01)
*E02F 9/22* (2006.01)
(Continued)

(52) U.S. Cl.
CPC ..... *E02F 9/2217* (2013.01); *E02F 9/2095* (2013.01); *E02F 9/2228* (2013.01);
(Continued)

(58) Field of Classification Search
CPC ..... F15B 11/024; F15B 2211/3058
See application file for complete search history.

(56) References Cited

U.S. PATENT DOCUMENTS 5,442,912 A * 8/1995 Hirata ..... E02F 9/2221 60/426
2008/0072749 A1* 3/2008 Pfaff ..... F15B 11/003 91/436
(Continued)

FOREIGN PATENT DOCUMENTS

JP 2000-136806 A 5/2000
JP 2009-299719 A 12/2009
(Continued)

OTHER PUBLICATIONS

International Search Report of PCT/JP2014/050718.

*Primary Examiner* — F. Daniel Lopez
(74) *Attorney, Agent, or Firm* — Mattingly & Malur, PC

(57) ABSTRACT

The hydraulic fluid energy recovery apparatus includes a fluid communication line for holding a bottom-side hydraulic fluid chamber and a rod-side hydraulic fluid chamber of a hydraulic cylinder in fluid communication with each other, a fluid communication valve connected to the fluid communication line for adjusting the pressure and/or flow rate of a hydraulic fluid passing through the fluid communication line in a manner that allows for adjustment of a degree of opening of the fluid communication valve, first pressure detecting means for detecting a signal indicative of pressure at the bottom-side hydraulic fluid chamber of the hydraulic cylinder, an amount-of-operation detecting means for detecting an amount of operation of the operating means, and a control device for capturing the signal of pressure at the bottom-side hydraulic fluid chamber of the hydraulic cylinder detected by the first pressure detecting means.

5 Claims, 8 Drawing Sheets

(51) Int. Cl.

| | |
|---|---|
| ***F15B 11/08*** | (2006.01) |
| ***F15B 21/14*** | (2006.01) |
| ***E02F 9/20*** | (2006.01) |

(52) U.S. Cl.

CPC ..... *E02F 9/2285* (2013.01); *E02F 9/2292* (2013.01); *E02F 9/2296* (2013.01); *F15B 11/024* (2013.01); *F15B 11/08* (2013.01); *F15B 21/14* (2013.01); *F15B 2211/3058* (2013.01); *F15B 2211/6313* (2013.01); *F15B 2211/6346* (2013.01)

(56) References Cited

U.S. PATENT DOCUMENTS

| | | | | |
|---|---|---|---|---|
| 2010/0089045 | A1* | 4/2010 | Shimada ..... | E02F 9/2228 60/327 |
| 2012/0304630 | A1 | 12/2012 | Kawasaki et al. | |

FOREIGN PATENT DOCUMENTS

| | | | |
|---|---|---|---|
| JP | 2010-210072 | A | 9/2010 |
| JP | 2011-179541 | A | 9/2011 |

* cited by examiner

HYDRAULIC FLUID ENERGY RECOVERY APPARATUS FOR WORK MACHINE

TECHNICAL FIELD

The present invention relates to a hydraulic fluid energy recovery apparatus for a work machine, and more particularly to a hydraulic fluid energy recovery apparatus for a work machine having a hydraulic cylinder.

BACKGROUND ART

There has been disclosed a hydraulic pressure energy recovery apparatus which is installed on a construction machine such as a hydraulic excavator or the like and which includes a hydraulic motor that is operated when a return hydraulic fluid flowing out of a hydraulic actuator such as a hydraulic cylinder flows into the hydraulic motor, an electric generator that generates electric energy when the drive power from the hydraulic motor is applied to the electric generator, and a battery that stores electric energy generated by the electric generator (see, for example, Patent document 1).

PRIOR ART DOCUMENT

Patent Documents

Patent Document 1: JP,A 2000-136806

SUMMARY OF THE INVENTION

Problems to be Solved by the Invention

According to the conventional art described above, if the hydraulic cylinder is applied as a boom cylinder for actuating the boom of a work machine, for example, then the return hydraulic fluid that is discharged from the bottom-side hydraulic fluid chamber of the boom cylinder when the boom falls by gravity flows at a large rate. Therefore, attempts to increase the efficiency with which to recover the return hydraulic fluid, for example, require the hydraulic motor and the electric generator to be of a capacity/large volume large enough to handle the hydraulic fluid flowing at the large rate, tending to make the energy recovery apparatus large in size. As a result, the energy recovery apparatus entails an increase in the manufacturing cost thereof, and is faced with the problem of an installation space on the construction machine.

The problem of an installation space may be solved simply by reducing the capacity of the energy recovery apparatus. However, since the reduced capacity of the energy recovery apparatus poses a limitation on the flow rate per unit time of the return hydraulic fluid that is flowing in, the speed at which the boom descends is lowered. As a consequence, the construction machine tends to have lower operability than standard construction machines that are not equipped with energy recovery apparatus.

Operability can be maintained by having the energy recovery apparatus recover only part of the return hydraulic fluid discharged from the bottom-side hydraulic fluid chamber of the boom cylinder. However, the solution makes it necessary to cause any return hydraulic fluid that cannot be recovered by the energy recovery apparatus to bleed off into a tank, resulting in the problem of a reduction in the energy recovery efficiency.

The present invention has been made in view of the above problems. It is an object of the present invention to provide a hydraulic fluid energy recovery apparatus which is capable of recovering energy efficiency from a work machine while allowing the work machine to ensure operability equivalent to standard construction machines without making the energy recovery apparatus large in size.

Means for Solving the Problems

In order to achieve the above object, according to a first aspect of the present invention, there is provided a hydraulic fluid energy recovery apparatus for a work machine including a hydraulic pump, a hydraulic cylinder for actuating a working assembly, operating means for operating the hydraulic cylinder, and a hydraulic motor for recovering a return hydraulic fluid from the hydraulic cylinder, comprising: a fluid communication line for holding a bottom-side hydraulic fluid chamber and a rod-side hydraulic fluid chamber of the hydraulic cylinder in fluid communication with each other; a fluid communication valve connected to the fluid communication line, for adjusting the pressure and/or flow rate of a hydraulic fluid passing through the fluid communication line in a manner that allows for adjustment of a degree of opening of the fluid communication valve; first pressure detecting means for detecting a signal indicative of pressure at the bottom-side hydraulic fluid chamber of the hydraulic cylinder; an amount-of-operation detecting means for detecting an amount of operation of the operating means; and a control device for capturing the signal of pressure at the bottom-side hydraulic fluid chamber of the hydraulic cylinder detected by the first pressure detecting means, and the amount of operation of the operating means detected by the amount-of-operation detecting means, calculating the speed of a piston rod of the hydraulic cylinder, and controlling the fluid communication valve responsive to the speed of the piston rod.

According to a second aspect of the present invention, there is provided a hydraulic fluid energy recovery apparatus for a work machine as described in the first aspect, wherein the control device controls the fluid communication valve so that the flow rate of the hydraulic fluid flowing in from the bottom-side hydraulic fluid chamber of the hydraulic cylinder to the rod-side hydraulic fluid chamber thereof is greater than the flow rate of the hydraulic fluid which is drawn into the rod-side hydraulic fluid chamber as the volume of the rod-side hydraulic fluid chamber, which is calculated from the speed of the piston rod, increases.

According to a third aspect of the present invention, there is provided a hydraulic fluid energy recovery apparatus for a work machine as described in the first aspect, further includes second pressure detecting means for detecting a signal indicative of pressure at the rod-side hydraulic fluid chamber of the hydraulic cylinder; wherein the control device controls the fluid communication valve such that the opening degree thereof decreases if the differential pressure exceeds a predetermined set pressure, the differential pressure measured between the pressure in the bottom-side hydraulic fluid chamber of the hydraulic cylinder detected by the first pressure detecting means, and the pressure in the rod-side hydraulic fluid chamber of the hydraulic cylinder detected by the second pressure detecting means; and controls the fluid communication valve such that the opening thereof is full open if the differential pressure between the pressure in the bottom-side hydraulic fluid chamber of the hydraulic cylinder and the pressure in the rod-side hydraulic fluid chamber of the hydraulic cylinder is equal to or lower than the preset pressure.

According to a fourth aspect of the present invention, there is provided a hydraulic fluid energy recovery apparatus for a work machine as described in the first aspect, further includes a pressure control valve which is opened to discharge the hydraulic fluid into a tank if the pressure of the hydraulic fluid in the hydraulic cylinder increases to a value equal to or higher than a relief pressure thereof; wherein the control device continues the fluid communication valve closing control if while the fluid communication valve is being closed, the differential pressure exceeds a predetermined set pressure, the differential pressure measured between the pressure in the bottom-side hydraulic fluid chamber of the hydraulic cylinder detected by the first pressure detecting means, and the relief pressure that the pressure control valve is to control.

According to a fifth aspect of the present invention, there is provided a hydraulic fluid energy recovery apparatus for a work machine as described in the first aspect, further includes a pressure control valve which is opened to discharge the hydraulic fluid into a tank if the pressure of the hydraulic fluid in the hydraulic cylinder increases to a value equal to or higher than a relief pressure thereof; wherein the control device control executes the fluid communication valve closing control if while the fluid communication valve is being open, the differential pressure exceeds a predetermined set pressure, the differential pressure measured between the pressure in the bottom-side hydraulic fluid chamber of the hydraulic cylinder detected by the first pressure detecting means, and the relief pressure that the pressure control valve is to control.

According to a sixth aspect of the present invention, there is provided a hydraulic fluid energy recovery apparatus for a work machine as described in any one of the first through fifth aspects, further includes a control valve controlled by the operating means, for changing over and supplying the hydraulic fluid from the hydraulic pump to the hydraulic cylinder; and a discharge valve disposed between the hydraulic cylinder and the control valve, for bringing the hydraulic fluid from the rod-side hydraulic fluid chamber of the hydraulic cylinder into a tank.

Advantages of the Invention

According to the present invention, the pressure of the return hydraulic fluid discharged from the bottom-side hydraulic fluid chamber of the hydraulic fluid cylinder is boosted and the flow rate of the return hydraulic fluid flowing into the hydraulic motor is reduced, while controlling the speed of the piston rod of the hydraulic fluid cylinder. It is thus possible to reduce the size of the hydraulic fluid energy recovery apparatus without causing a reduction in the recovered energy. As a result, the work machine is allowed to ensure operability equivalent to standard construction machines, and the efficiency with which to recover energy can be increased.

MODE FOR CARRYING OUT THE INVENTION

Hydraulic fluid energy recovery apparatus for a work machine according to embodiments of the present invention will be described below with reference to the drawings.

Embodiment 1

Figure 1:
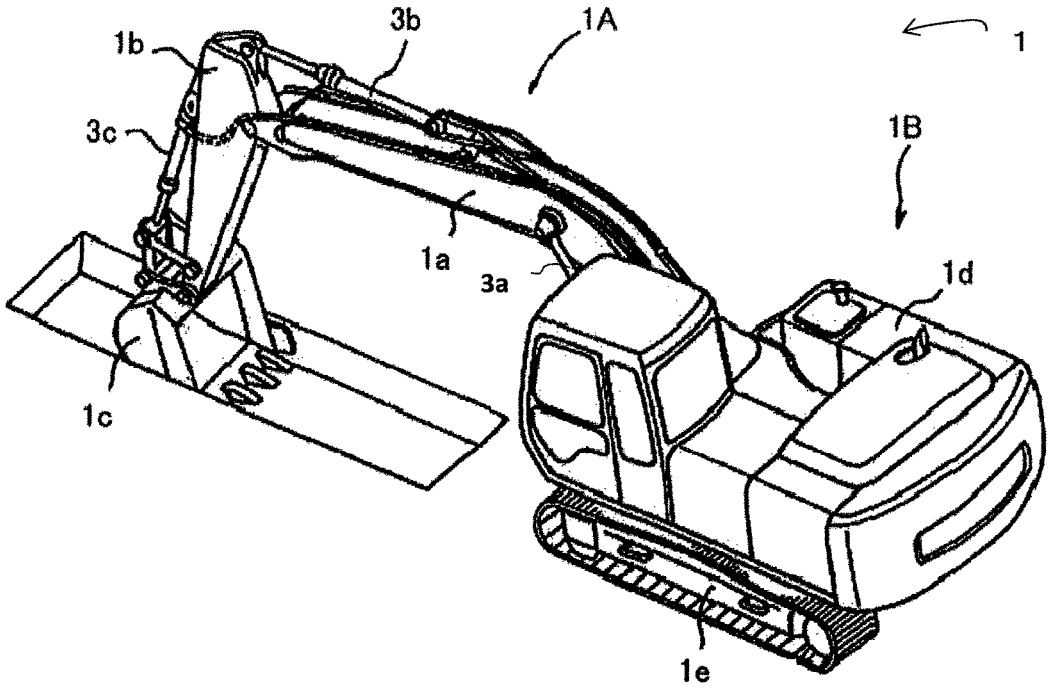
FIG. 1 is a perspective view of a hydraulic excavator which incorporates therein a hydraulic fluid energy recovery apparatus for a work machine according to a first embodiment of the present invention.
Figure 2:
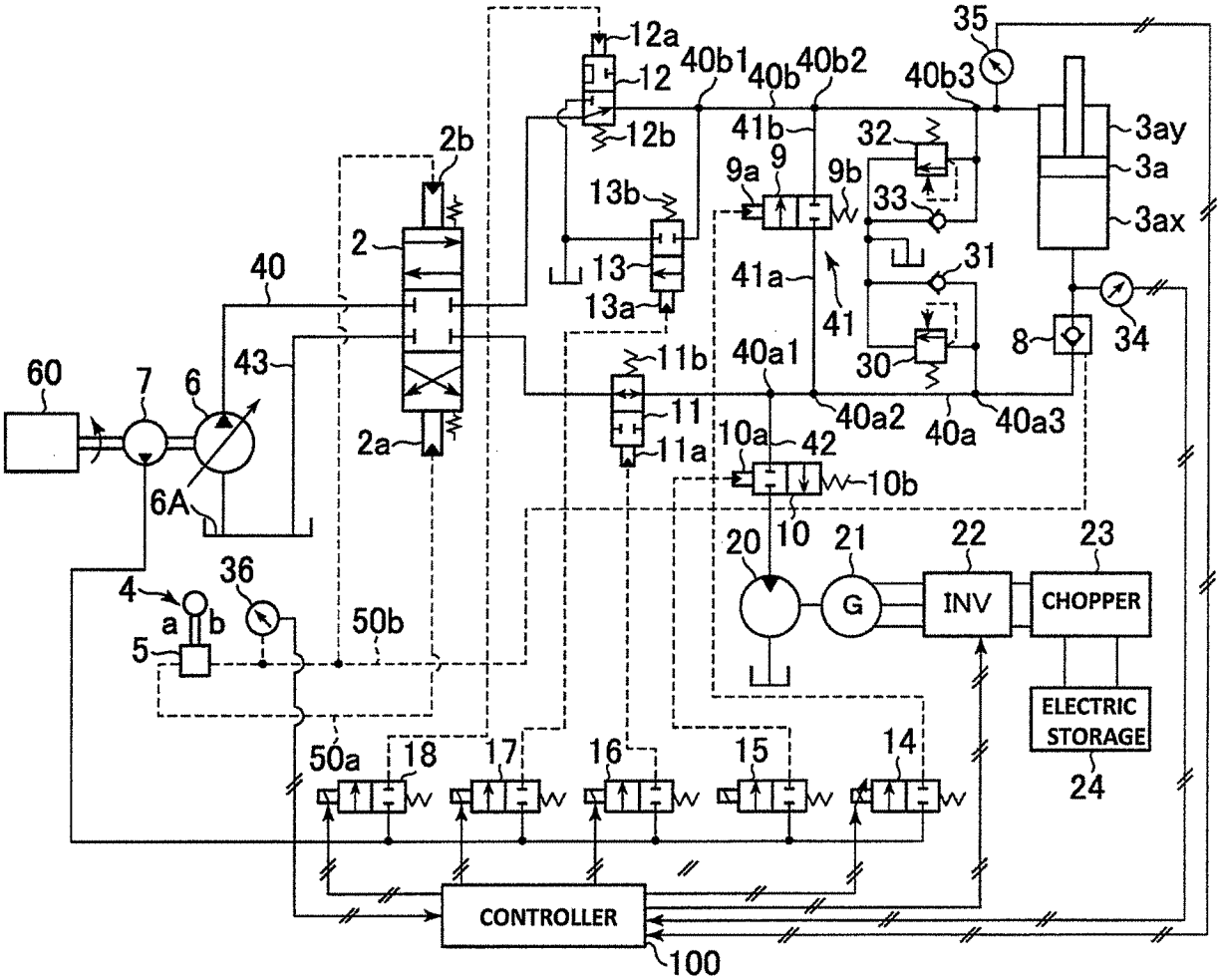
FIG. 2 is a schematic diagram of a control system of the hydraulic fluid energy recovery apparatus for the work machine according to the first embodiment of the present invention.

FIG. 1 is a perspective view of a hydraulic excavator which incorporates therein a hydraulic fluid energy recovery apparatus for a work machine according to a first embodiment of the present invention, and FIG. 2 is a schematic diagram of a control system of the hydraulic fluid energy recovery apparatus for the work machine according to the first embodiment of the present invention.

As shown in FIG. 1, a hydraulic excavator 1 includes an articulated working assembly 1A having a boom 1*a*, an arm 1*b*, and a bucket 1*c*, and a vehicle assembly 1B having an upper swing structure 1*d* and a lower track structure 1*e*. The boom 1*a* is angularly movably supported on the upper swing structure 1*d*, and is actuated by a boom cylinder (hydraulic cylinder) 3*a*. The upper swing structure 1*d* is swingably mounted on the lower track structure 1*e*.

The arm 1*b* is angularly movably supported on the boom 1*a*, and is actuated by an arm cylinder (hydraulic cylinder) 3*b*. The bucket 1*c* is angularly movably supported on the arm 1*b*, and is actuated by a bucket cylinder (hydraulic cylinder) 3*c*. The boom cylinder 3*a*, the arm cylinder 3*b*, and the bucket cylinder 3*c* are controlled by an operating device 4 (see FIG. 2) which is installed in the operating room (cabin) of the upper swing structure 1*d* and which outputs hydraulic signals.

In the embodiment shown in FIG. 2, only a control system with respect to the boom cylinder 3*a* for operating the boom 1*a* is illustrated. The control system includes a control valve 2, the operating device 4, a pilot check valve 8, a fluid communication control valve 9, a recovery selector valve 10, a bottom-side hydraulic fluid chamber line selector valve 11, a rod-side hydraulic fluid chamber line selector valve 12, a discharge selector valve (discharge valve) 13, a solenoid proportional valve 14, first through fourth solenoid selector valves 15 through 18, an inverter 22, a chopper 23, an electric storage device 24, and pressure sensors 34 through 36, and has a controller 100 as a control device.

The control system includes a hydraulic pump 6, a pilot hydraulic pump 7, and a tank 6A as a hydraulic fluid source. The hydraulic pump 6 and the pilot hydraulic pump 7 are coupled to each other by a drive shaft and actuated by an engine 60 that is connected to the drive shaft.

A line 40 for supplying a hydraulic fluid from the hydraulic pump 6 to the boom cylinder 3*a* is connected to the control valve 2, which is a four-port, three-position control valve for controlling the direction and flow rate of the hydraulic fluid in the line 40. The control valve 2 changes its spool position in response to pilot hydraulic fluids supplied to pilot pressure bearing members 2*a*, 2*b* thereof, supplying the hydraulic fluid from the hydraulic pump 6 to the boom cylinder 3*a* thereby to actuate the boom 1*a*.

The control valve 2 has an inlet port supplied with the hydraulic fluid from the hydraulic pump 6, the inlet port being connected to the hydraulic pump 6 by the line 40. The control valve 2 has an outlet port connected to the tank 6A by a return line 43.

The control valve 2 has a connection port connected to an end of a line 40*a* from a bottom-side hydraulic fluid chamber 3*ax* of the boom cylinder 3*a*, and another end of the bottom-side hydraulic fluid chamber line 40*a* is connected to the bottom-side hydraulic fluid chamber 3*ax* of the boom cylinder 3*a*. The control valve 2 has another connection port connected to an end of a line 40*b* from a rod-side hydraulic fluid chamber 3*ay* of the boom cylinder 3*a*, and another end of the rod-side hydraulic fluid chamber line 40*b* is connected to the rod-side hydraulic fluid chamber 3*ay* of the boom cylinder 3*a*.

To the bottom-side hydraulic fluid chamber line 40*a*, there are connected the bottom-side hydraulic fluid chamber line selector valve 11, which is a two-port, two-position selector valve, a recovery branch point 40*a*1, a fluid communication branch point 40*a*2, a relief branch point 40*a*3, the pilot check valve 8, and the pressure sensor 34 as a first pressure detecting means, successively in the order named from the control valve 2. A recovery line 42 is connected to the recovery branch point 40*a*1, whereas a bottom-side hydraulic fluid chamber fluid communication line 41*a* is connected to the fluid communication branch point 40*a*2.

To the relief branch point 40*a*3, there are connected an outlet of a first makeup valve 31 that allows the working fluid to be drawn in only and an inlet of a first overload relief valve 30 that releases the working fluid into the tank 6A when the pressure in the bottom-side hydraulic fluid chamber line 40*a* is equal to or higher than a preset pressure. An inlet of the first makeup valve 31 and an outlet of the first overload relief valve 30 are connected to a line that is held in fluid communication with the tank 6A. The first makeup valve 31 serves to prevent a cavitation from being developed by a negative pressure in the bottom-side hydraulic fluid chamber line 40*a*. The first overload relief valve 30 serves to prevent pipes and devices from being damaged owing to a pressure buildup of the hydraulic fluid in the bottom-side hydraulic fluid chamber line 40*a*.

The bottom-side hydraulic fluid chamber line selector valve 11 has a spring 11*b* on one end thereof and a pilot pressure bearing member 11*a* on the other end thereof. Depending on whether a pilot hydraulic fluid is supplied to the pilot pressure bearing member 11*a* or not, the bottom-side hydraulic fluid chamber line selector valve 11 changes its spool position to control the passing and blocking of the hydraulic fluid between the control valve 2 and the bottom-side hydraulic fluid chamber 3*ax* of the boom cylinder 3*a*. The pilot pressure bearing member 11*a* is supplied with the pilot hydraulic fluid from the pilot hydraulic pump 7 through the second solenoid selector valve 16 to be described later.

The pressure sensor 34 (first pressure detecting means) functions as a signal converting means for detecting the pressure of the hydraulic fluid in the bottom-side hydraulic fluid chamber 3*ax* of the boom cylinder 3*a* and converting the detected pressure into an electric signal corresponding thereto. The pressure sensor 34 is arranged to output the converted electric signal to the controller 100.

To the rod-side hydraulic fluid chamber line 40*b*, there are connected the rod-side hydraulic fluid chamber line selector valve 12, which is a three-port, two-position selector valve, a return branch point 40*b*1, a fluid communication branch point 40*b*2, a relief branch point 40*b*3, and the pressure sensor 35 as a second pressure detecting means, successively in the order named from the control valve 2. A line that is held in fluid communication with the tank 6A through the discharge selector valve (discharge valve) 13, which is a two-port, two-position selector valve, is connected to the return branch point 40*b*1, whereas a rod-side hydraulic fluid chamber fluid communication line 41*b* is connected to the fluid communication branch point 40*b*2.

To the relief branch point 40*b*3, there are connected an outlet of a second makeup valve 33 that allows the working fluid to be drawn in only and an inlet of a second overload relief valve 32 that releases the working fluid into the tank 6A when the pressure in the rod-side hydraulic fluid chamber line 40*b* is equal to or higher than a preset pressure. An inlet of the second makeup valve 33 and an outlet of the second overload relief valve 32 are connected to a line that is held in fluid communication with the tank 6A. The second makeup valve 33 serves to prevent a cavitation from being developed by a negative pressure in the rod-side hydraulic fluid chamber line 40*b*. The second overload relief valve 32 serves to prevent pipes and devices from being broken owing to a pressure buildup of the hydraulic fluid in the rod-side hydraulic fluid chamber line 40*b*.

The rod-side hydraulic fluid chamber line selector valve 12 has a spring 12*b* on one end thereof and a pilot pressure bearing member 12*a* on the other end thereof. Depending on whether a pilot hydraulic fluid is supplied to the pilot pressure bearing member 12*a* or not, the rod-side hydraulic fluid chamber line selector valve 12 changes its spool position. When the pilot hydraulic fluid is not applied to the pilot pressure bearing member 12*a*, the rod-side hydraulic fluid chamber line selector valve 12 has its spool positioned to supply the hydraulic fluid delivered from the hydraulic pump 6 through the control valve 2 to the rod-side hydraulic fluid chamber 3*ay* of the boom cylinder 3*a*. When the pilot hydraulic fluid is applied to the pilot pressure bearing member 12*a*, the rod-side hydraulic fluid chamber line selector valve 12 has its spool positioned to discharge the hydraulic fluid delivered from the hydraulic pump 6 into the tank 6A and to prevent the hydraulic fluid from being discharged from the rod-side hydraulic fluid chamber line 40*b* into the tank 6A. The pilot pressure bearing member 12*a* is supplied with the pilot hydraulic fluid from the pilot hydraulic pump 7 through the fourth solenoid selector valve 18 to be described later.

The discharge selector valve 13 has a spring 13*b* on one end thereof and a pilot pressure bearing member 13*a* on the other end thereof. Depending on whether a pilot hydraulic fluid is supplied to the pilot pressure bearing member 13*a* or not, the discharge selector valve 13 changes its spool position to control the discharging and blocking of the hydraulic fluid from the rod-side hydraulic fluid chamber line 40*b* into the tank 6A. The pilot pressure bearing member 13*a* is supplied with the pilot hydraulic fluid from the pilot hydraulic pump 7 through the third solenoid selector valve 17 to be described later.

The pressure sensor 35 (second pressure detecting means) functions as a signal converting means for detecting the pressure of the hydraulic fluid in the rod-side hydraulic fluid chamber 3*ay* of the boom cylinder 3*a* and converting the detected pressure into an electric signal corresponding thereto. The pressure sensor 35 is arranged to output the converted electric signal to the controller 100.

The rod-side hydraulic fluid chamber fluid communication line 41*b* of the rod-side hydraulic fluid chamber line 40*b* has one end connected to the fluid communication branch point 40*b*2 and the other end to an outlet port of the fluid communication control valve 9, which is a two-port, two-position selector control valve. The fluid communication control valve 9 has an inlet port connected to an end of the bottom-side hydraulic fluid chamber fluid communication line 41*a* whose other end is connected to the fluid communication branch point 40*a*2 of the bottom-side hydraulic fluid chamber line 40*a*. The bottom-side hydraulic fluid chamber fluid communication line 41*a*, the fluid communication control valve 9, and the rod-side hydraulic fluid chamber fluid communication line 41*b* make up a fluid communication line 41 for introducing the return hydraulic fluid from the bottom-side hydraulic fluid chamber 3*ax* of the boom cylinder 3*a* into the rod-side hydraulic fluid chamber 3*ay* of the boom cylinder 3*a* while controlling the flow rate of the hydraulic fluid.

The fluid communication control valve 9 has a spring 9*b* on one end thereof and a pilot pressure bearing member 9*a* on the other end thereof, and controls the area of the opening thereof through which the hydraulic fluid passes depending on the value of the pressure under which the pilot hydraulic fluid is supplied to the pilot pressure bearing member 9*a*.

The control valve 2 has its spool position changed by operating an operating lever or the like of the operating device 4. The operating device 4 includes a pilot valve 5, which generates a secondary pilot hydraulic fluid under a pilot pressure Pu based on the amount of a tilted operation of the operating lever or the like in the direction "a" in FIG. 2 (the direction to lift the boom), from a primary pilot hydraulic fluid that is supplied through a primary pilot hydraulic fluid line, not shown, from the pilot hydraulic pump 7. The secondary pilot hydraulic fluid is supplied through a secondary pilot hydraulic fluid line 50*a* to the pilot pressure bearing member 2*a* of the control valve 2. The control valve 2 is controlled to change over by the pilot pressure Pu.

Similarly, the pilot valve 5 generates a secondary pilot hydraulic fluid under a pilot pressure Pd based on the amount of a tilted operation of the operating lever or the like in the direction "b" in FIG. 2 (the direction to lower the boom). The secondary pilot hydraulic fluid is supplied through a secondary pilot hydraulic fluid line 50*b* to the pilot pressure bearing member 2*b* of the control valve 2. The control valve 2 is controlled to change over by the pilot pressure Pd.

Therefore, the control valve 2 has its spool moved depending on the pilot pressures Pu, Pd applied to the respective pilot pressure bearing members 2*a*, 2*b*, changing the direction and flow rate of the hydraulic fluid that is supplied from the hydraulic pump 6 to the boom cylinder 3*a*.

The secondary pilot hydraulic fluid under the pilot pressure Pd is also supplied through the secondary pilot hydraulic fluid line 50*b* to the pilot check valve 8. When the pilot pressure Pd is applied to the pilot check valve 8, the pilot check valve 8 is opened. Then, the hydraulic fluid is led from the bottom-side hydraulic fluid chamber 3*ax* of the boom cylinder 3*a* into the bottom-side hydraulic fluid chamber line 40*a*. The pilot check valve 8 serves to prevent the hydraulic fluid from flowing accidentally into the bottom-side hydraulic fluid chamber line 40*a* (and to prevent the boom from falling), so that it usually blocks the circuit and opens when the pilot hydraulic fluid pressure is applied thereto.

The pressure sensor 36 (pilot pressure detecting means) is connected to the secondary pilot hydraulic fluid line 50*b*. The pressure sensor 36 functions as a signal converting means for detecting the pressure of the boom-lowering pilot pressure Pd from the pilot valve 5 of the operating device 4 and converting the detected pressure into an electric signal corresponding thereto. The pressure sensor 36 is arranged to output the converted electric signal to the controller 100.

A power recovery apparatus 70 will now be described below. As shown in FIG. 2, the power recovery apparatus 70 includes a recovery line 42, the fluid communication line 41, the solenoid proportional valve 14, the first through fourth solenoid selector valves 15 through 18, the hydraulic motor 20, the electric generator 21, the inverter 22, the chopper 23, the electric storage device 24, and the controller 100.

The recovery line 42 is provided with the recovery selector valve 10 and the hydraulic motor 20 that is disposed downstream of the recovery selector valve 10 and mechanically connected to the electric generator 21. The recovery line 42 leads the return hydraulic fluid from the bottom-side hydraulic fluid chamber 3*ax* of the boom cylinder 3*a* through the hydraulic motor 20 into the tank 6A. When the return hydraulic fluid is introduced into the recovery line 42 at the time the boom is lowered and the hydraulic motor 20 is rotated, the electric generator 21 is rotated to generate electric energy, which is then stored into the electric storage device 24 through the inverter 22 and the chopper 23 that serves as a boost chopper.

The recovery selector valve 10 has a spring 10*b* on one end thereof and a pilot pressure bearing member 10*a* on the other end thereof. Depending on whether a pilot hydraulic fluid is supplied to the pilot pressure bearing member 10*a* or not, the recovery selector valve 10 changes its spool position to control the influx and blocking of the return hydraulic fluid from the bottom-side hydraulic fluid chamber 3*ax* of the boom cylinder 3*a* into the hydraulic motor 20. The pilot pressure bearing member 10*a* is supplied with a pilot hydraulic fluid from the pilot hydraulic pump 7 through the first solenoid selector valve 15 to be described later.

The rotational speed of the hydraulic motor 20 and the electric generator 21 at the time the boom is lowered is controlled by the inverter 22. Since the flow rate of the hydraulic fluid passing through the hydraulic motor 20 can be adjusted by controlling the rotational speed of the hydraulic motor 20 with the inverter 22, the flow rate of the return hydraulic fluid that flows from the bottom-side hydraulic fluid chamber 3*ax* into the recovery line 42 can be adjusted. In other words, the inverter 22 according to the present embodiment functions as a flow rate control means for controlling the flow rate of the hydraulic fluid in the recovery line 42.

The fluid communication line 41 leads the return hydraulic fluid that flows from the bottom-side hydraulic fluid chamber 3*ax* of the boom cylinder 3*a* through the fluid communication control valve 9 into the rod-side hydraulic fluid chamber 3*ay* of the boom cylinder 3*a* while controlling the flow rate of the return hydraulic fluid. A pilot hydraulic fluid that is delivered from the pilot hydraulic pump 7 through the solenoid proportional valve 14 is applied to the pilot pressure bearing member 9*a* of the fluid communication control valve 9. Since the fluid communication control valve 9 has its spool moved depending on the pressure of the pilot hydraulic fluid applied to the pilot pressure bearing member 9*a*, the area of the opening thereof through which the hydraulic fluid passes is controlled. It is thus possible to control the flow rate of the return hydraulic fluid that flows from the bottom-side hydraulic fluid chamber 3*ax* of the boom cylinder 3*a* into the rod-side hydraulic fluid chamber 3*ay* thereof.

The solenoid proportional valve 14 converts a primary pilot hydraulic fluid that is supplied from the pilot hydraulic pump 7 into a secondary pilot hydraulic fluid having a desired pressure, and supplies the secondary pilot hydraulic fluid to the pilot pressure bearing member 9*a* of the fluid communication control valve 9, in response to a command signal from the controller 100. The flow rate of the return hydraulic fluid that passes from the bottom-side hydraulic fluid chamber 3*ax* through the fluid communication control valve 9 (in other words, the flow rate of the return hydraulic fluid flowing through the fluid communication line 41) is thus adjusted. In other words, the solenoid proportional valve 14 according to the present embodiment functions as a flow rate control means for controlling the flow rate in the fluid communication line 41.

The solenoid proportional valve 14 according to the present embodiment has an inlet port supplied with the hydraulic fluid delivered from the pilot hydraulic pump 7. A command value output from a solenoid proportional valve output value processor 104 (see FIG. 4), to be described later, of the controller 100 is applied to an operating unit of the solenoid proportional valve 14. Depending on the command value, the spool position of the solenoid proportional valve 14 is adjusted, thereby adjusting the pressure of the pilot hydraulic fluid that is supplied from the pilot hydraulic pump 7 to the pilot pressure bearing member 9*a* of the fluid communication control valve 9.

The first solenoid selector valve 15 controls the supplying and blocking of the pilot hydraulic fluid supplied from the pilot hydraulic pump 7 to the pilot pressure bearing member 10*a* of the recovery selector valve 10 in response to a command signal from the controller 100.

The second solenoid selector valve 16 controls the supplying and blocking of the pilot hydraulic fluid supplied from the pilot hydraulic pump 7 to the pilot pressure bearing member 11*a* of the bottom-side hydraulic fluid chamber line selector valve 11 in response to a command signal from the controller 100.

The third solenoid selector valve 17 controls the supplying and blocking of the pilot hydraulic fluid supplied from the pilot hydraulic pump 7 to the pilot operating member 13*a* of the discharge selector valve 13 in response to a command signal from the controller 100.

The fourth solenoid selector valve 18 controls the supplying and blocking of the pilot hydraulic fluid supplied from the pilot hydraulic pump 7 to the pilot operating member 12*a* of the rod-side hydraulic fluid chamber line selector valve 12 in response to a command signal from the controller 100.

The first through fourth solenoid selector valves 15 through 18 have respective inlet ports supplied with the hydraulic fluid delivered from the pilot hydraulic pump 7. The first through fourth solenoid selector valves 15 through 18 have respective operating units supplied with respective command signals output from a selector valve sequence control processor 102 (FIG. 4), to be described later, of the controller 100.

The controller 100 is supplied with the data on the pressure in the bottom-side hydraulic fluid chamber 3*ax* of the boom cylinder 3*a* from the pressure sensor 34, the pressure in the rod-side hydraulic fluid chamber 3*ay* of the boom cylinder 3*a* from the pressure sensor 35, and the boom-lowering pilot pressure Pd of the pilot valve 5 of the operating device 4 from the pressure sensor 36, performs a processing sequence based on the supplied values, and decides whether a process for recovering the energy of the return hydraulic fluid is to be carried out or not. When the process for recovering the energy of the return hydraulic fluid is carried out, the controller 100 outputs control commands to the solenoid proportional valve 14, the first through fourth solenoid selector valves 15 through 18, and the inverter 22 to control the flow rate of the return hydraulic fluid flowing from the boom cylinder 3*a* through the fluid communication line 41, for increasing the pressure of the return hydraulic fluid flowing into the recovery line 42 and reducing the flow rate thereof. In this manner, the controller 100 boosts the pressure of the return hydraulic fluid discharged from the bottom-side hydraulic fluid chamber 3*ax* of the boom cylinder 3*a* and reduces the flow rate of the return hydraulic fluid flowing into the hydraulic motor 20, while controlling the speed of the piston rod of the boom cylinder 3*a*. It is thus possible to reduce the size of the hydraulic fluid energy recovery apparatus without causing a reduction in the recovered energy.

An outline of operation of the various components which are actuated by operating the operating device 4 will be given below with reference to FIG. 2.

When the operating lever of the operating device 4 is first tilted in the direction "a" (the direction to lift the boom), the pilot pressure Pu generated by the pilot valve 5 is applied to the pilot pressure bearing member 2*a* of the control valve 2, changing over the control valve 2. The hydraulic fluid from the hydraulic pump 6 is led through the bottom-side hydraulic fluid chamber line selector valve 11 into the bottom-side hydraulic fluid chamber line 40*a*, and flows through the pilot check valve 8 into the bottom-side hydraulic fluid chamber 3*ax* of the boom cylinder 3*a*. As a result, the boom cylinder 3*a* is extended.

The return hydraulic fluid that is discharged from the rod-side hydraulic fluid chamber 3*ay* of the boom cylinder 3*a* as a result is led through the rod-side hydraulic fluid chamber, line 40*b*, the rod-side hydraulic fluid chamber line selector valve 12, and the control valve 2 into the tank 6A. At this time, since the fluid communication control valve 9 is closed, no hydraulic fluid flows into the fluid communication line 41, and since the recovery selector valve 10 is also closed, no hydraulic fluid flows into the recovery line 42.

When the operating lever of the operating device 4 is then tilted in the direction "b" (the direction to lower the boom), the pilot pressure Pd generated by the pilot valve 5 is detected by the pressure sensor 36 and supplied to the controller 100. The controller 100 decides whether the process for recovering the energy of the return hydraulic fluid is to be carried out or not, on the basis of the pressure, detected by the pressure sensor 34, in the bottom-side hydraulic fluid chamber 3*ax* of the boom cylinder 3*a*.

If the controller 100 decides that the process for recovering the energy of the return hydraulic fluid is not to be carried out, then the pilot pressure Pd generated by the pilot valve 5 is applied to the pilot pressure bearing member 2*b* of the control valve 2 and the pilot check valve 8, causing the control valve 2 to change over and also causing the pilot check valve 8 to open. The hydraulic fluid from the hydraulic pump 6 is led through the rod-side hydraulic fluid chamber line selector valve 12 into the rod-side hydraulic fluid chamber line 40*b* and flows into the rod-side hydraulic fluid chamber 3*ay* of the boom cylinder 3*a*. As a result, the boom cylinder 3*a* is contracted. The return hydraulic fluid that is discharged from the bottom-side hydraulic fluid chamber 3*ax* of the boom cylinder 3*a* as a result is led through the pilot check valve 8, the bottom-side hydraulic fluid chamber line 40*a*, the bottom-side hydraulic fluid chamber line selector valve 11, and the control valve 2 into the tank 6A. At this time, since the fluid communication control valve 9 is closed, no hydraulic fluid flows into the fluid communication line 41, and since the recovery selector valve 10 is also closed, no hydraulic fluid flows into the recovery line 42.

If the controller 100 decides that the process for recovering the energy of the return hydraulic fluid is to be carried out, then the controller 100 further reads the pressure, detected by the pressure sensor 35, in the rod-side hydraulic fluid chamber 3*ay* of the boom cylinder 3*a*, performs a processing operation, and outputs respective commands to the first, second, and fourth solenoid valves for thereby opening the recovery selector valve 10, closing the bottom-side hydraulic fluid chamber line selector valve 11, and closing the rod-side hydraulic fluid chamber line selector valve 12. The hydraulic fluid from the hydraulic pump 6 is now discharged into the tank 6A, and the return hydraulic fluid from the bottom-side hydraulic fluid chamber 3*ax* of the boom cylinder 3*a* is blocked from flowing toward the control valve 2.

The controller 100 outputs a control command to the solenoid proportional valve 14 depending on the pressures input thereto. As a result, a pilot pressure is applied to the pilot pressure bearing member 9*a* of the fluid communication control valve 9, controlling the area of the opening of the fluid communication control valve 9. The return hydraulic fluid from the bottom-side hydraulic fluid chamber 3*ax* of the boom cylinder 3*a* is led through the fluid communication line 41 and the rod-side hydraulic fluid chamber line 40*b* into the rod-side hydraulic fluid chamber 3*ay* of the boom cylinder 3*a*, contracting the boom cylinder 3*a*. The pressure of the return hydraulic fluid discharged from the bottom-side hydraulic fluid chamber 3*ax* of the boom cylinder 3*a* is now increased.

At this time, inasmuch as the pilot pressure Pd from the pilot valve 5 is led as an operating pressure to the pilot check valve 8 through the secondary pilot hydraulic fluid line 50*b*, the pilot check valve 8 is opened. Part of the return hydraulic fluid discharged from the bottom-side hydraulic fluid chamber 3*ax* of the boom cylinder 3*a* is led through the recovery selector valve 10 to the hydraulic motor 20, so that the electric generator 21 connected to the hydraulic motor 20 generates electric energy. The generated electric energy is stored in the electric storage device 24. As the amount of the return hydraulic fluid discharged from the bottom-side hydraulic fluid chamber 3*ax* of the boom cylinder 3*a* is divided into the amount of hydraulic fluid flowing into the fluid communication line 41 and the amount of hydraulic fluid flowing into the recovery line 42, the amount of the return hydraulic fluid that flows into the recovery line 42 is reduced.

The controller 100 decides a state from the input signal representing the pilot pressure Pd, the input signal representing the pressure in the bottom-side hydraulic fluid chamber 3*ax* of the boom cylinder 3*a*, and the input signal representing the pressure in the rod-side hydraulic fluid chamber 3*ay* of the boom cylinder 3*a*, and calculates and outputs command values to the first through fourth solenoid selector valves 15 through 18, a command value to the solenoid proportional valve 14, and a control command value to the inverter 22 which serves as a control device for the electric generator 21. As a consequence, since the amount of the return hydraulic fluid discharged from the bottom-side hydraulic fluid chamber 3*ax* of the boom cylinder 3*a* while the boom is being lowered is divided into the amount of hydraulic fluid flowing toward the fluid communication control valve 9 (the amount of hydraulic fluid flowing into the fluid communication line 41) and the amount of hydraulic fluid flowing toward the hydraulic motor 20 for energy recovery (the amount of hydraulic fluid for energy recovery), the hydraulic fluid energy recovery apparatus can perform appropriate energy recovery while maintaining operability for the work machine.

Figure 3:
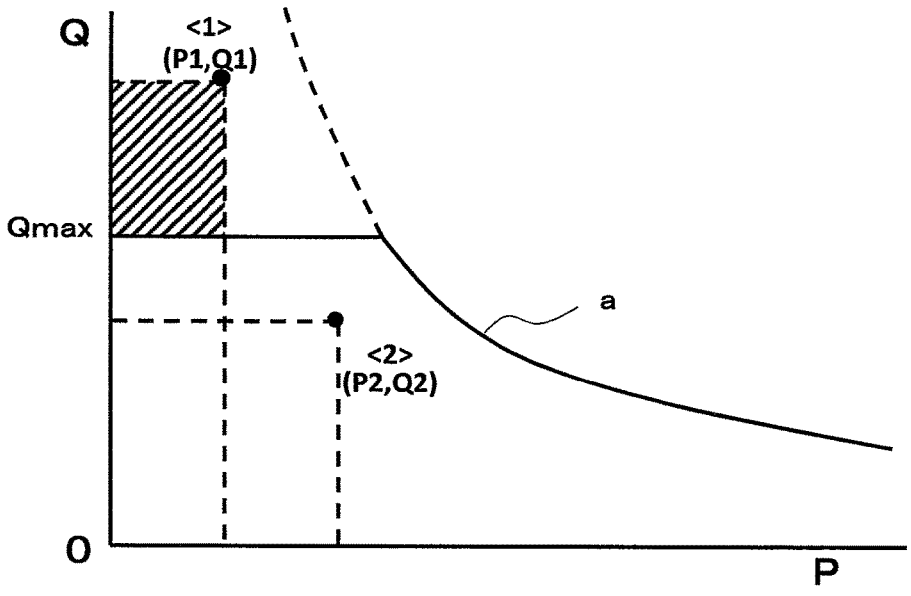
FIG. 3 is a characteristic diagram showing a horsepower curve of the hydraulic fluid energy recovery apparatus for the work machine according to the first embodiment of the present invention.
Figure 4:
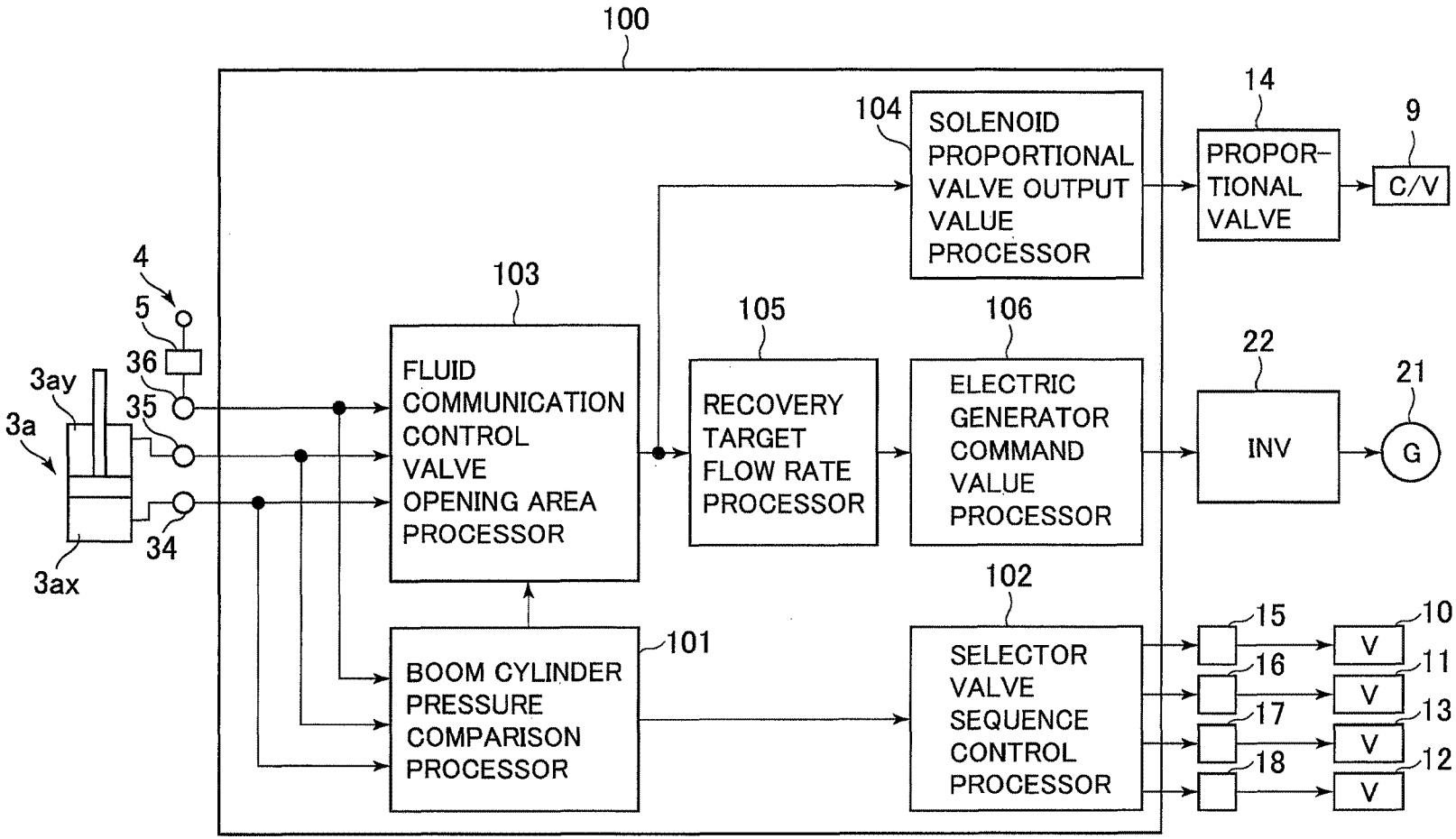
FIG. 4 is a block diagram of a controller of the hydraulic fluid energy recovery apparatus for the work machine according to the first embodiment of the present invention.

An outline of the control process of the controller 100 will be given below with reference to FIGS. 3 and 4. FIG. 3 is a characteristic diagram showing a horsepower curve of the hydraulic fluid energy recovery apparatus for the work machine according to the first embodiment of the present invention, and FIG. 4 is a block diagram of a controller of the hydraulic fluid energy recovery apparatus for the work machine according to the first embodiment of the present invention. In FIGS. 3 and 4, those reference characters which are identical to those shown in FIGS. 1 and 2 denote identical parts, and will not be described in detail below.

In FIG. 3, the horizontal axis represents the pressure P of the return hydraulic fluid flowing into the recovery apparatus, and the vertical axis represents the flow rate Q of the return hydraulic fluid flowing into the recovery apparatus, with the horsepower of the recovery apparatus being indicated by a solid-line characteristic curve "a". If the pressure and flow rate of the return hydraulic fluid flowing out of the bottom-side hydraulic fluid chamber 3*ax* of the boom cylinder 3*a* are in a state <1> (P1, Q1), then since the flow rate Q1 exceeds a maximum flow rate Qmax of the recovery apparatus, the energy (shown hatched) of the return hydraulic fluid which is in excess of the maximum flow rate Qmax cannot be recovered.

The pressure and flow rate of the return hydraulic fluid can change to a state <2> (P2, Q2) by supplying part of the return hydraulic fluid from the bottom-side hydraulic fluid chamber 3*ax* of the boom cylinder 3*a* through the fluid communication line 41 to the rod-side hydraulic fluid chamber 3*ay* of the boom cylinder 3*a*. For example, therefore, the pressure P1 of the return hydraulic fluid in the state <1> can be brought to the pressure P2, which is about twice the pressure P1, and the flow rate Q1 thereof can similarly be brought to the flow rate Q2, which is about half the flow rate Q1. In the state <2>, since the recovery apparatus can recover all the energy of the return hydraulic fluid, the amount of recovered energy is increased compared with the state <1>.

According to the present embodiment, the controller 100 controls the flow rate and pressure of the hydraulic fluid supplied through the fluid communication line 41 to the rod-side hydraulic fluid chamber 3*ay* of the boom cylinder 3*a* by controlling the area of the opening of the fluid communication control valve 9, and controls the flow rate of the hydraulic fluid flowing from the recovery line 42 into the hydraulic motor 20 with the electric generator 21 and the inverter 22.

The controller 100 shown in FIG. 4 includes a pressure comparison processor 101, a selector valve sequence control processor 102, a fluid communication control valve opening area processor 103, a solenoid proportional valve output value processor 104, a recovery target flow rate processor 105, and an electric generator command value processor 106.

As shown in FIG. 4, the pressure comparison processor 101 is supplied with the data on the pressure, detected by the pressure sensor 34, in the bottom-side hydraulic fluid chamber 3*ax* of the boom cylinder 3*a*, the pressure, detected by the pressure sensor 35, in the rod-side hydraulic fluid chamber 3*ay* of the boom cylinder 3*a*, and the boom-lowering pilot pressure Pd, detected by the pressure sensor 36, from the pilot valve 5 of the operating device 4, and carries out a first processing operation for deciding whether the fluid communication control valve 9 is to be opened or not, a second processing operation for changing control modes, to be described later, of the fluid communication control valve 9, and a third processing operation for generating a changeover signal for the discharge selector valve 13.

The first processing operation will first be described below. Provided that the area of the piston in the rod-side hydraulic fluid chamber 3*ay* of the boom cylinder 3*a* is represented by Ar and the area of the piston in the bottom-side hydraulic fluid chamber 3*ax* of the boom cylinder 3*a* by Ab, when the boom is lowered and the fluid communication control valve 9 is opened, the pressure in the bottom-side hydraulic fluid chamber 3*ax* of the boom cylinder 3*a* is boosted up to Ab/Ar times at maximum. Because the area Ab of the piston in the bottom-side hydraulic fluid chamber 3*ax* is about twice the area Ar of the piston in the rod-side hydraulic fluid chamber 3*ay* on ordinary hydraulic excavators, the pressure in the bottom-side hydraulic fluid chamber 3*ax* of the boom cylinder 3*a* is boosted about twice. Consequently, when the fluid communication control valve 9 is opened while the pressure in the bottom-side hydraulic fluid chamber 3*ax* remains high, pipes and devices may possibly be damaged.

In the first processing operation, the following inequality is assessed:

$$Pb1 \cdot Ab/Ar - Polr > Pset1 \quad (1)$$

where Pb1 represents the pressure in the bottom-side hydraulic fluid chamber 3*ax* of the boom cylinder 3*a* before the fluid communication control valve 9 is opened, Polr a pressure set for the first overload relief valve 30, and Pset1 a differential pressure set for permitting energy recovery.

The fluid communication control valve 9 is opened, and if it is decided that the differential pressure between the boosted pressure in the bottom-side hydraulic fluid chamber 3*ax* of the boom cylinder 3*a* and the pressure Polr set for the first overload relief valve 30 exceeds the differential pressure Pset1 set for permitting energy recovery according to the inequality (1), then the pressure comparison processor 101 outputs a command for not boosting the pressure and recovering energy to the selector valve sequence control processor 102. If it is decided that the differential pressure is equal to or lower than the differential pressure Pset1 set for permitting energy recovery, then the pressure comparison processor 101 outputs a command for recovering energy to the selector valve sequence control processor 102.

The second processing operation is used to select a control mode for the fluid communication control valve 9 when it is opened. When the fluid communication control valve 9 is opened, the hydraulic fluid flows from the bottom-side hydraulic fluid chamber 3*ax* of the boom cylinder 3*a* into the rod-side hydraulic fluid chamber 3*ay* thereof, resulting in a pressure buildup in the rod-side hydraulic fluid chamber 3*ay* as well as the bottom-side hydraulic fluid chamber 3*ax*. At this time, the differential pressure between the pressure in the bottom-side hydraulic fluid chamber 3*ax* and the pressure in the rod-side hydraulic fluid chamber 3*ay* is monitored, and the following inequality (2) is assessed in order to select a control mode:

$$Pb2 - Pr2 > Pset2 \quad (2)$$

where Pb2 represents the pressure in the bottom-side hydraulic fluid chamber 3*ax* of the boom cylinder 3*a*, Pr2 the pressure in the rod-side hydraulic fluid chamber 3*ay* of the boom cylinder 3*a*, and Pset2 a differential pressure set for adjustment.

The fluid communication control valve 9 is opened, and if it is decided that the differential pressure between the boosted pressure in the bottom-side hydraulic fluid chamber 3*ax* of the boom cylinder 3*a* and the pressure in the rod-side hydraulic fluid chamber 3*ay* thereof exceeds the differential pressure Pset2 set for adjustment according to the inequality (2), then the pressure comparison processor 101 outputs a command for performing a control process for adjusting the opening area to the fluid communication control valve opening area processor 103. If it is decided that the differential pressure is equal to or lower than the differential pressure Pset2 set for adjustment, then the pressure comparison processor 101 outputs a command for performing a control process for fully opening the opening to the fluid communication control valve opening area processor 103. It is decided whether the pressure in the bottom-side hydraulic fluid chamber 3*ax* of the boom cylinder 3*a* has been fully boosted and the flow rate of the hydraulic fluid flowing through the fluid communication line 41 into the rod-side hydraulic fluid chamber 3*ay* has become constant or not. If the flow rate has become constant, then the control process for fully opening the opening is performed in order to minimize any pressure loss.

The third processing operation serves to generate a changeover signal for the discharge selector valve 13. When the fluid communication control valve 9 is opened, a pressure buildup is developed in the rod-side hydraulic fluid chamber 3*ay* as well as the bottom-side hydraulic fluid chamber 3*ax*. When the operating lever of the operating device 4 is subsequently returned to its neutral position, for example, the fluid communication valve 9 changes from the open state to the closed state, whereupon the hydraulic fluid under the boosted pressure may possibly remain in the rod-side hydraulic fluid chamber line 40*b*. The differential pressure between the pressure in the bottom-side hydraulic fluid chamber 3*ax* and the pressure in the rod-side hydraulic fluid chamber 3*ay* is monitored, and the following inequality (3) is assessed in order to control the discharging of the remaining hydraulic fluid:

$$Pb2 - Pr2 > Pset3 \quad (3)$$

where Pb2 represents the pressure in the bottom-side hydraulic fluid chamber 3*ax* of the boom cylinder 3*a*, Pr2 the pressure in the rod-side hydraulic fluid chamber 3*ay* of the boom cylinder 3*a*, and Pset3 a differential pressure set for changeover.

After the energy of the hydraulic fluid is recovered, if it is decided that the differential pressure between the boosted pressure in the bottom-side hydraulic fluid chamber 3*ax* of the boom cylinder 3*a* and the pressure in the rod-side hydraulic fluid chamber 3*ay* thereof exceeds the differential pressure Pset3 set for changeover according to the inequality (3), then the pressure comparison processor 101 outputs a command for changing over the discharge selector valve 13 in order to bring the rod-side hydraulic fluid chamber line 40*b* and the tank 6A into fluid communication with each other.

The selector valve sequence control processor 102 is a section for calculating control commands for the first through fourth solenoid selector valves 15 through 18 on the basis of a command output from the pressure comparison processor 101.

When the selector valve sequence control processor 102 is supplied with a command for recovering energy from the pressure comparison processor 101, the selector valve sequence control processor 102 outputs commands for changing the recovery selector valve 10 to the open state, the bottom-side hydraulic fluid chamber line selector valve 11 to the closed state, the rod-side hydraulic fluid chamber line selector valve 12 to the closed state, and the discharge selector valve 13 to the closed state, respectively to the first, second, fourth, and third solenoid selector valves. The hydraulic fluid from the hydraulic pump 6 is now drained into the tank 6A, whereas the return hydraulic fluid from the bottom-side hydraulic fluid chamber 3*ax* of the boom cylinder 3*a* is prevented from flowing toward the control valve 2.

When the selector valve sequence control processor 102 is supplied with a command for not recovering energy from the pressure comparison processor 101, the selector valve sequence control processor 102 outputs commands for changing the recovery selector valve 10 to the closed state, the bottom-side hydraulic fluid chamber line selector valve 11 to the open state, the rod-side hydraulic fluid chamber line selector valve 12 to the open state, and the discharge selector valve 13 to the closed state, respectively to the first, second, fourth, and third solenoid selector valves. No energy is recovered upon descent of the boom, and the return hydraulic fluid from the bottom-side hydraulic fluid chamber 3*ax* of the boom cylinder 3*a* is drained into the tank 6A while being adjusted in flow rate by the control valve 2.

As shown in FIG. 4, the fluid communication control valve opening area processor 103 is supplied with the data on the pressure, detected by the pressure sensor 34, in the bottom-side hydraulic fluid chamber 3*ax* of the boom cylinder 3*a*, the pressure, detected by the pressure sensor 35, in the rod-side hydraulic fluid chamber 3*ay* of the boom cylinder 3*a*, the boom-lowering pilot pressure Pd, detected by the pressure sensor 36, from the pilot valve 5 of the operating device 4, and a control mode selection command from the pressure comparison processor 101, and calculates an opening area control command for the fluid communication control valve 9.

Operation of the fluid communication control valve opening area processor 103 at the time it is supplied with an opening area adjustment control command from the pressure comparison processor 101 will first be described below. According to the present embodiment, it is assumed that when the piston rod of the boom cylinder 3*a* is retracted, the hydraulic fluid is drawn at a flow rate Qr0 into the rod-side hydraulic fluid chamber 3*ay* depending on the volume thereof as it varies on account of the movement of the piston rod, in order to boost the pressure in the bottom-side hydraulic fluid chamber 3*ax*. The fluid communication control valve opening area processor 103 controls the opening area A of the fluid communication control valve 9 so that the hydraulic fluid can flow from the bottom-side hydraulic fluid chamber 3*ax* into the rod-side hydraulic fluid chamber 3*ay* at a flow rate k×Qr0. The constant k is of a value greater than the area ratio Ar/Ab between the area Ar of the piston in the rod-side hydraulic fluid chamber 3*ay* and the area Ab of the piston in the bottom-side hydraulic fluid chamber 3*ax*, as indicated by the inequality (4):

$$k>Ar/Ab \tag{4}$$

In other words, when the piston rod of the boom cylinder 3*a* is retracted, the volume of the rod-side hydraulic fluid chamber 3*ay* is changed to supply the hydraulic fluid to the rod-side hydraulic fluid chamber 3*ay* at a high flow rate, compressing and boosting the pressure of the hydraulic fluid in the bottom-side hydraulic fluid chamber 3*ax*. If the value of the constant k is too high, the hydraulic fluid is delivered excessively into the rod-side hydraulic fluid chamber 3*ay*, tending to increase the pressure in the bottom-side hydraulic fluid chamber 3*ax* more than necessary transiently. Consequently, it may become difficult to control the speed of the piston rod at a target level, and the behavior of the piston rod may be disturbed. It is necessary to set the coefficient k to an appropriate value in order to boost the pressures in the rod-side hydraulic fluid chamber 3*ay* and the bottom-side hydraulic fluid chamber 3*ax* while controlling the speed of the piston rod at a target level and keeping the piston rod in good behavior.

A specific process of calculating the opening area A of the fluid communication control valve 9 will be described below. It is assumed that a target bottom flow rate for the flow rate of the hydraulic fluid flowing from the bottom-side hydraulic fluid chamber 3*ax* of the boom cylinder 3*a* is represented by Qb0 which is determined depending on the boom-lowering pilot pressure Pd, detected by the pressure sensor 36, from the pilot valve 5 of the operating device 4; the flow rate of the hydraulic fluid drawn into the rod-side hydraulic fluid chamber 3*ay* depending on the volume thereof as it varies on account of the movement of the piston rod by Qr0; the flow rate of the hydraulic fluid passing through the fluid communication control valve 9 by Q; the speed of the piston rod by V; the pressure in the bottom-side hydraulic fluid chamber 3*ax* by Pb; the pressure in the rod-side hydraulic fluid chamber 3*ay* by Pr; the area of the piston in the rod-side hydraulic fluid chamber 3*ay* of the boom cylinder 3*a* by Ar; and the area of the piston in the bottom-side hydraulic fluid chamber 3*ax* of the boom cylinder 3*a* by Ab. The target bottom flow rate Qb0 and the flow rate Qr0 are calculated as follows:

$$Qb0=Ab\cdot V \tag{5}$$

$$Qr0=Ar\cdot V \tag{6}$$

The equation (5) is substituted in the equation (6), which is solved for the flow rate Qr0 according to the equation (7).

$$Qr0=Ar/Ab\cdot Qb0 \tag{7}$$

The flow rate Q of the hydraulic fluid passing through the fluid communication control valve 9 is calculated according to a general orifice formula represented by the equation (8).

$$Q=CA\sqrt{(Pb-Pr)} \tag{8}$$

where C represents a flow rate coefficient. Since the hydraulic fluid is delivered into the rod-side hydraulic fluid chamber 3*ay* at a flow rate that is k times the flow rate Qr0 at which the hydraulic fluid is drawn into the rod-side hydraulic fluid chamber 3*ay* as it changes the volume, the flow rate Q is expressed by the following equation (9):

$$Q=k\cdot Qr0 \tag{9}$$

The equations (8), (7) are substituted in the equation (9), which is solved for the opening area A according to the equation (10).

$$A=Ar\cdot k\cdot Qb0/(Ab\cdot C\sqrt{(Pb-Pr)}) \quad (10)$$

By controlling the opening area A of the fluid communication control valve 9 according to the equation (10), it is possible to boost the hydraulic pressure in the rod-side hydraulic fluid chamber 3*ay* and the hydraulic pressure in the bottom-side hydraulic fluid chamber 3*ax* while controlling the speed of the piston rod at a target level and keeping the piston rod in good behavior.

Operation of the fluid communication control valve opening area processor 103 at the time it is supplied with a full opening control command from the pressure comparison processor 101 will be described below. As the opening area A of the fluid communication control valve 9 is adjusted to boost the pressures in the rod-side hydraulic fluid chamber 3*ay* and the bottom-side hydraulic fluid chamber 3*ax* according to the above opening area adjustment control process, when the opening of the fluid communication control valve 9 is sufficiently large, the hydraulic pressure in the rod-side hydraulic fluid chamber 3*ay* and the hydraulic pressure in the bottom-side hydraulic fluid chamber 3*ax* become essentially equal to each other, and the boosting of the pressures is completed. In this state, the pressures are not boosted further, and the flow rate Q of the hydraulic fluid flowing through the fluid communication control valve 9 into the rod-side hydraulic fluid chamber 3*ay* is kept constant at a value that is calculated by multiplying the target bottom flow rate Qb0 by the area ratio (Ar/Ab) between the bottom-side hydraulic fluid chamber and the rod-side hydraulic fluid chamber.

Specifically, the situation wherein the boosting of the hydraulic pressure in the bottom-side hydraulic fluid chamber 3*ax* is completed and the flow rate of the hydraulic fluid flowing through the fluid communication circuit into the rod-side hydraulic fluid chamber 3*ay* becomes constant is determined on the basis of the differential pressure between the hydraulic pressure in the rod-side hydraulic fluid chamber 3*ay* and the hydraulic pressure in the bottom-side hydraulic fluid chamber 3*ax*, and the determined situation is output as a full opening control command from the pressure comparison processor 101. Therefore, the fluid communication control valve opening area processor 103 outputs a full opening command instead of the above described opening area command for the fluid communication control valve 9.

The fluid communication control valve opening area processor 103 outputs either the above opening area command for the fluid communication control valve 9 or the full opening command to the solenoid proportional valve output value processor 104 and the recovery target flow rate processor 105.

The solenoid proportional valve output value processor 104 calculates an output value to be output from the solenoid proportional valve 14 that is required to achieve the opening area A of the fluid communication control valve 9, which has been calculated by the fluid communication control valve opening area processor 103 (i.e., a pressure (pilot pressure) represented by a hydraulic pressure signal to be applied from the solenoid proportional valve 14 to the pilot pressure bearing member 9*a* of the fluid communication control valve 9), and the solenoid proportional valve output value processor 104 further outputs to the solenoid proportional valve 14 a command value for enabling the solenoid proportional valve 14 to output the thus calculated output value. The solenoid proportional valve 14 that is supplied with the output value calculated by the solenoid proportional valve output value processor 104 outputs an operating signal based on the output value to the fluid communication control valve 9, which allows the hydraulic fluid to flow through the fluid communication line 41 at a flow rate calculated by the fluid communication control valve opening area processor 103.

The recovery target flow rate processor 105 calculates a target recovery flow rate for the recovery apparatus on the basis of the opening area command, etc. for the fluid communication control valve 9, which has been calculated by the fluid communication control valve opening area processor 103. If the opening area command is output, then a recovery-side target flow rate Qk0 is calculated according to the following equations (11), (12):

$$Qk0=Qb0-Q \quad (11)$$

The equation (11) is substituted in the equation (8), providing the equation (12).

$$Qk0=Qb0-CA\sqrt{(Pb-Pr)} \quad (12)$$

If the full opening command is output, then the recovery-side target flow rate Qk0 is calculated according to the following equation (13):

$$Qk0=Qb0(1-Ar/Ab) \quad (13)$$

The recovery target flow rate processor 105 outputs the recovery-side target flow rate Qk0 described above to the electric generator command value processor 106.

The electric generator command value processor 106 is a section for calculating a rotational speed for the hydraulic motor 20, which is required for the hydraulic motor 20 on the recovery line 42 to draw in the hydraulic fluid at the recovery-side target flow rate Qk0 calculated by the recovery target flow rate processor 105, and outputting a rotational speed command value for rotating the hydraulic motor 20 at the calculated rotational speed to the inverter 22. The inverter 22 that is supplied with the rotational speed command value calculated by the electric generator command value processor 106 rotates the hydraulic motor 20 and the electric generator 21 on the basis of the rotational speed command value, causing the return hydraulic fluid to flow through the recovery line 42 at the flow rate calculated by the recovery target flow rate processor 105. If a target rotational speed for the electric generator 21 is represented by NO and the volume of the hydraulic motor 20 by q, then the target rotational speed NO is calculated according to the following equation (14):

$$N0=Qk0/q \quad (14)$$

The electric generator command value processor 106 outputs a speed command to the inverter 22 in order to achieve the target rotational speed determined according to the equation (14).

Figure 5:
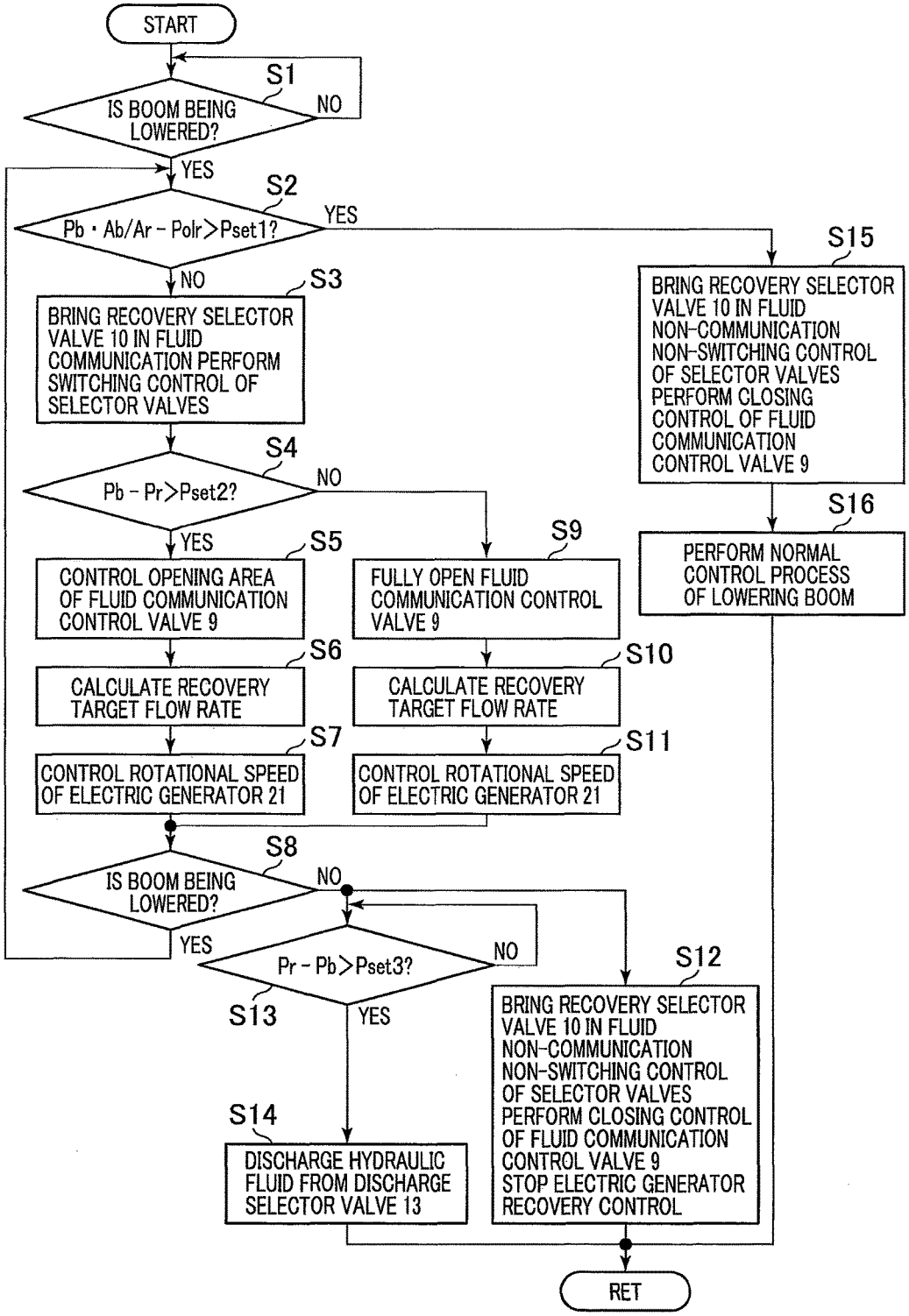
FIG. 5 is a flowchart of a processing sequence of the controller of the hydraulic fluid energy recovery apparatus for the work machine according to the first embodiment of the present invention.
Figure 6:
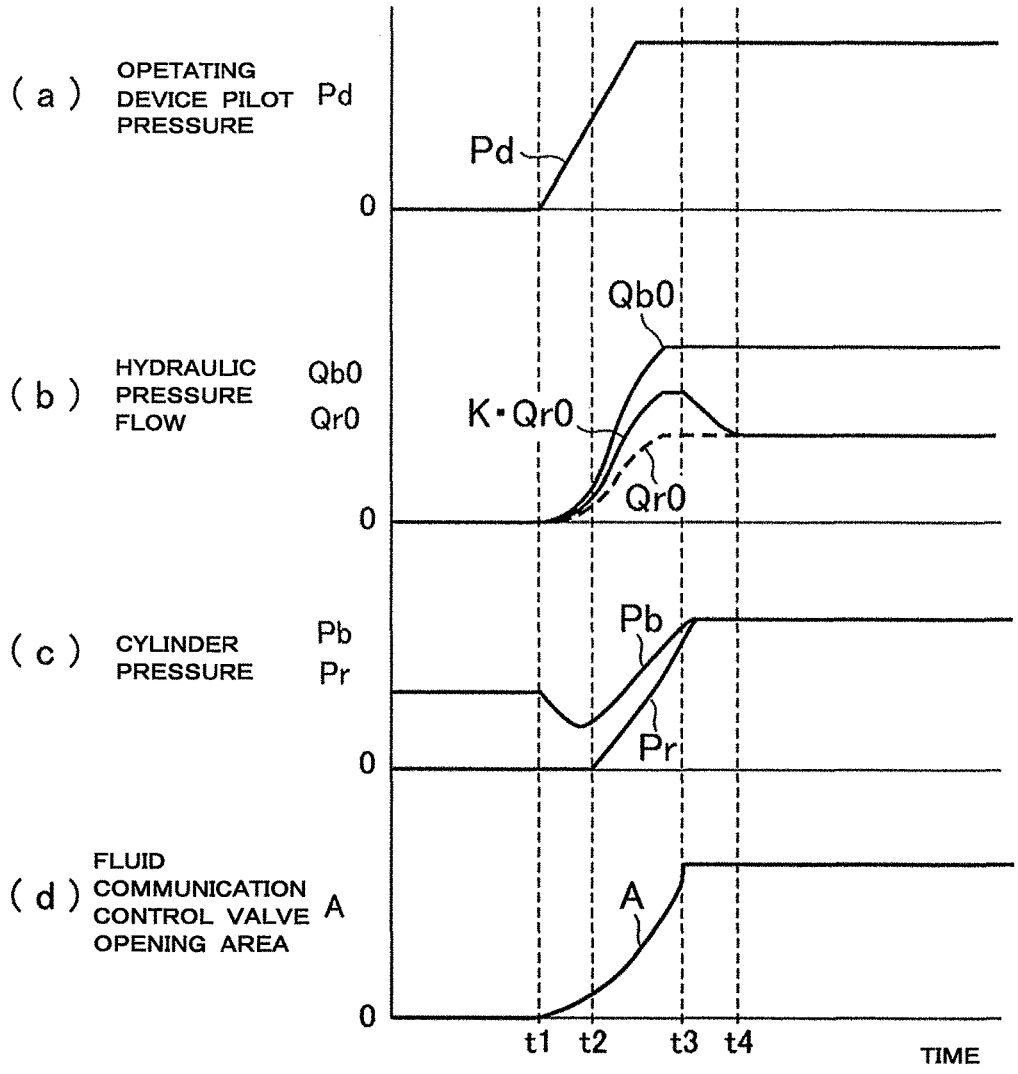
FIG. 6 is a characteristic diagram that illustrates control details of the controller of the hydraulic fluid energy recovery apparatus for the work machine according to the first embodiment of the present invention.

A processing sequence of the controller 100 and the characteristics of various components according to the present embodiment will be described below with reference to FIGS. 5 and 6. FIG. 5 is a flowchart of a processing sequence of the controller of the hydraulic fluid energy recovery apparatus for the work machine according to the first embodiment of the present invention, and FIG. 6 is a characteristic diagram that illustrates control details of the controller of the hydraulic fluid energy recovery apparatus for the work machine according to the first embodiment of the present invention. In FIGS. 5 and 6, those reference characters which are identical to those shown in FIGS. 1 through 4 denote identical parts, and will not be described in detail below.

The controller 100 decides whether the boom is being lowered or not (step S1). Specifically, the controller 100 decides whether the pilot pressure Pd detected by the pressure sensor 36 is higher than a preset pressure or not. If the pilot pressure Pd is higher than the preset pressure, then the controller 100 decides that the boom is being lowered. Control then goes to step S2. Otherwise, control goes back to step S1.

In order to determine whether the energy of the hydraulic fluid is to be recovered or not, the controller 100 decides whether the differential pressure between the pressure in the bottom-side hydraulic fluid chamber 3*ax* of the boom cylinder 3*a* before the fluid communication control valve 9 is opened and the pressure set for the first overload relief valve 30 is higher than the differential pressure Pset1 set for permitting energy recovery or not (step S2). If the calculated differential pressure is higher than the differential pressure Pset1 set for permitting energy recovery, then control goes to step S15 for recovering no energy and performing a normal control process of lowering the boom. Otherwise, control goes to step S3 for performing a control process of recovering energy.

First, the normal control process of lowering the boom from step S15 on will be described below. The controller 100 continuously controls the fluid communication control valve 9 to be closed, and outputs commands for changing the recovery selector valve 10 to the closed state, the bottom-side hydraulic fluid chamber line selector valve 11 to the open state, the rod-side hydraulic fluid chamber line selector valve 12 to the open state, and the discharge selector valve 13 to the closed state, respectively to the first, second, fourth, and third solenoid selector valves 15, 16, 18, and 17 (step S15).

The controller 100 performs the normal control process of lowering the boom (step S16). The pilot pressure Pd generated by the pilot valve 5 of the operating device 4 acts on the pilot pressure bearing member 2*b* of the control valve 2 and the pilot check valve 8, changing over the control valve 2 and opening the pilot check valve 8. This allows the hydraulic fluid from the hydraulic pump 6 to be led through the rod-side hydraulic fluid chamber line selector valve 11 into the rod-side hydraulic fluid chamber line 40*b*, and to flow into the rod-side hydraulic fluid chamber 3*ay* of the boom cylinder 3*a*. As a result, the boom cylinder 3*a* is contracted. The return hydraulic fluid that is consequently discharged from the bottom-side hydraulic fluid chamber 3*ax* of the boom cylinder 3*a* is led through the pilot check valve 8, the bottom-side hydraulic fluid chamber line 40*a*, the bottom-side hydraulic fluid chamber line selector valve 11, and the control valve 2 into the tank 6A. Since the fluid communication control valve 9 is closed at this time, no hydraulic fluid flows through the fluid communication line 41. Since the recovery selector valve 10 is also closed, no hydraulic fluid flows through the recovery line 42. After the present step is executed, control returns to the main routine.

If the calculated differential pressure is equal to or lower than the differential pressure Pset1 set for permitting energy recovery in step S2, then the controller 100 performs a control process for recovering energy (step S3). Specifically, the controller 100 outputs commands for changing over the recovery selector valve 10 to the open state, the bottom-side hydraulic fluid chamber line selector valve 11 to the closed state, the rod-side hydraulic fluid chamber line selector valve 12 to the closed state, and the discharge selector valve 13 to the closed state, respectively to the first, second, fourth, and third solenoid selector valves. The return hydraulic fluid from the bottom-side hydraulic fluid chamber 3*ax* of the boom cylinder 3*a* does not flow toward the control valve 2, but starts flowing into the recovery line 42. The hydraulic fluid from the hydraulic pump 6 is discharged through the control valve 2 and the rod-side hydraulic fluid chamber line selector valve 12 into the tank 6A. Therefore, the pump power can be reduced.

In order to determine a control mode for the fluid communication control valve 9, the controller 100 decides whether the differential pressure between the boosted pressure in the bottom-side hydraulic fluid chamber 3*ax* of the boom cylinder 3*a* and the pressure in the rod-side hydraulic fluid chamber 3*ay* thereof exceeds the predetermined differential pressure Pset2 set for adjustment or not (step S4). In other words, the controller 100 decides whether the boosting of the pressure in the bottom-side hydraulic fluid chamber 3*ax* of the boom cylinder 3*a* is completed and the flow rate of the hydraulic fluid flowing through the fluid communication line 41 into the rod-side hydraulic fluid chamber 3*ay* becomes constant or not. If the flow rate of the hydraulic fluid becomes constant, the controller 100 changes to a control process for fully opening the fluid communication control valve 9 (step S9) in order to minimize any pressure loss. If the calculated differential pressure is higher than the predetermined differential pressure Pset2 set for adjustment, then control goes to step S5 for performing the control process for adjusting the opening area. Otherwise, control goes to step S9 for performing the control process for fully opening the opening.

The controller 100 performs the control process for adjusting the opening area of the fluid communication control valve 9 (step S5). Specifically, the controller 100 calculates an opening area for the fluid communication control valve 9 on the basis of the target bottom flow rate determined from the amount of operation of the operating lever of the operating device 4, the hydraulic pressure in the bottom-side hydraulic fluid chamber 3*ax*, and the hydraulic pressure in the rod-side hydraulic fluid chamber 3*ay*, so that the hydraulic fluid can flow into the rod-side hydraulic fluid chamber 3*ay* at a flow rate that is k times the flow rate at which the hydraulic fluid is drawn into the rod-side hydraulic fluid chamber 3*ay* as it changes the volume upon descent of the boom. The controller 100 outputs a command signal to the solenoid proportional valve 14 in order to achieve the calculated opening area. The opening area of the fluid communication control valve 9 is controlled by the pilot pressure generated by the solenoid proportional valve 14, allowing the hydraulic fluid to flow from the bottom-side hydraulic fluid chamber 3*ax* through the fluid communication line 41 into the rod-side hydraulic fluid chamber 3*ay*. As a result, the above operation makes it possible to boost the hydraulic pressure in the rod-side hydraulic fluid chamber 3*ay* and the hydraulic pressure in the bottom-side hydraulic fluid chamber 3*ax* while controlling the speed of the piston rod at a target level and keeping the piston rod in good behavior.

The behaviors of various components in the control process for adjusting the opening area will be described below. In FIG. 6, the horizontal axis represents time and vertical axes shown in (a) through (d) represent, successively in the order from above, the boom-lowering pilot pressure Pd of the operating device 4, the hydraulic fluid flow rates Qb0, Qr0, the boom cylinder pressures Pb, Pr, and the opening area A of the fluid communication control valve 9. FIG. 6 shows the characteristics in the control process for adjusting the opening area from time t1 to time t3, and shows the characteristics in the control process for fully opening the opening from time t3 to time t4.

When the operator operates the operating lever of the boom operating device 4 downwardly at time t1, the controller 100 is supplied with the pilot pressure Pd shown in (a), determines a target bottom-side hydraulic fluid chamber flow rate Qb0 shown in (b), and can calculate a rod-side hydraulic fluid chamber flow rate Qr0, indicated by the broken-line curve, which is commensurate with the volume change. By multiplying the rod-side hydraulic fluid chamber flow rate Qr0 which is commensurate with the volume change by k, the controller 100 determines a target flow rate for the hydraulic fluid passing through the fluid communication control valve 9, and is capable of opening the fluid communication control valve 9 while appropriately constricting the same, by setting k to an optimum value. As a result, the controller 100 can boost the bottom-side hydraulic fluid chamber pressure Pb while keeping the bottom-side hydraulic fluid chamber flow rate Qb0 in conformity with a target value. Time t2 represents a time at which the pressure Pr is generated in the rod-side hydraulic fluid chamber 3*ay* while the opening area of the fluid communication control valve 9 is thus being controlled.

Time t3 represents a time at which the differential pressure calculated in step S4 becomes equal to or lower than the differential pressure Pset2 set for adjustment. The control process for adjusting the opening area is carried out up to time t3.

Referring back to FIG. 5, the controller 100 calculates a target flow rate for energy recovery (step S6). Specifically, the controller 100 calculates a recovery target flow rate from the target bottom-side hydraulic fluid chamber flow rate Qb0 and the target flow rate for the hydraulic fluid passing through the fluid communication control valve 9.

The controller 100 performs a control process for controlling a target rotational speed for the electric generator 21 (step S7). Specifically, the controller 100 calculates an electric generator target rotational speed from the recovery target flow rate calculated in step S6. The controller 100 outputs an electric generator target rotational speed command to the inverter 22. The hydraulic fluid from the bottom-side hydraulic fluid chamber 3*ax* of the boom cylinder 3*a* rotates the hydraulic motor 20 while the flow rate of the hydraulic fluid is being controlled. Since the electric generator 21 which is coupled to the hydraulic motor 20 generates electric energy, the energy of the hydraulic fluid is stored as the electric energy through the inverter 22 and the chopper 23 into the electric storage device 24.

The controller 100 decides whether the boom is being lowered or not (step S8). Specifically, the controller 100 decides whether the pilot pressure Pd detected by the pressure sensor 36 is higher than a preset pressure or not. If the pilot pressure Pd is higher than the preset pressure, then the controller 100 decides that the boom is being lowered. Control then goes to step S2. Otherwise, control goes back to step S12 and step S13.

When control goes from step S8 to step S2, the controller 100 determines again whether the energy of the hydraulic fluid is to be recovered or not. This is because the controller 100 measures the pressure in the bottom-side hydraulic fluid chamber 3*ax* at all times and checks whether the measured pressure reaches the pressure set for the first overload relief valve 30 or not, even when the energy is recovered while the hydraulic pressure is being boosted. If the differential pressure between the pressure in the bottom-side hydraulic fluid chamber 3*ax* and the pressure Polr set for the first overload relief valve 30 reaches the differential pressure Pset1 set for permitting energy recovery, then control goes to step S15 for thereby closing the fluid communication control valve 9 and interrupting the energy recovery process even while the boom is being lowered.

The control process thus performed makes it possible to avoid the danger of uninterrupted behavior of the cylinder 3*a* due to accidental operation of the first overload relief valve 30.

Then, again in step S4, the controller 100 decides whether the differential pressure between the pressure in the bottom-side hydraulic fluid chamber 3*ax* of the boom cylinder 3*a* and the pressure in the rod-side hydraulic fluid chamber 3*ay* thereof exceeds the predetermined differential pressure Pset2 set for adjustment or not. If the controller 100 decides that the boosting of the pressure in the bottom-side hydraulic fluid chamber 3*ax* is completed and the flow rate of the hydraulic fluid flowing through the fluid communication line 41 into the rod-side hydraulic fluid chamber 3*ay* becomes constant, then control goes to step S9.

The controller 100 performs the control process for fully opening the opening (step S9). Specifically, in order to minimize any pressure loss of the hydraulic fluid passing through the fluid communication line 41, the controller 100 outputs a command signal to the solenoid proportional valve 14 so as to fully open the fluid communication control valve 9.

The behaviors of various components in the control process for fully opening the opening will be described below with reference to FIG. 6.

At time t3, the differential pressure between the pressure in the bottom-side hydraulic fluid chamber 3*ax* of the boom cylinder 3*a* and the pressure in the rod-side hydraulic fluid chamber 3*ay* thereof is equal to or lower than the differential pressure Pset set for adjustment. It is thus determined that the pressure in the bottom-side hydraulic fluid chamber 3*ax* has been boosted up to a maximum limit, and the opening of the fluid communication control valve 9 is fully opened in order to reduce an energy loss due to a pressure loss. As shown in (b), the flow rate of the hydraulic fluid passing through the fluid communication line 41 decreases toward the rod-side hydraulic fluid chamber flow rate Qr0 which is commensurate with the volume change, and converges at time t4.

Referring back to FIG. 5, the controller 100 calculates a recovery target flow rate (step S10). Specifically, the controller 100 calculates a recovery target flow rate from the target bottom-side hydraulic fluid chamber flow rate Qb0 and the target flow rate for the hydraulic fluid passing through the fluid communication control valve 9.

The controller 100 performs a control process for controlling a target rotational speed for the electric generator 21 (step S11). Specifically, the controller 100 calculates an electric generator target rotational speed from the recovery target flow rate calculated in step S10. The controller 100 outputs an electric generator target rotational speed command to the inverter 22. The hydraulic fluid from the bottom-side hydraulic fluid chamber 3*ax* of the boom cylinder 3*a* rotates the hydraulic motor 20 while the flow rate of the hydraulic fluid is being controlled. Since the electric generator 21 which is coupled to the hydraulic motor 20 generates electric energy, the energy of the hydraulic fluid is stored as the electric energy through the inverter 22 and the chopper 23 into the electric storage device 24.

The controller 100 decides whether the boom is being lowered or not (step S8). If the boom is being lowered, then control then goes to step S2. Otherwise, control goes back to step S12 and step S13.

If the boom is not being lowered, then the controller 100 closes the fluid communication valve 9, canceling the energy recovery operation (step S12). Specifically, the controller 100 outputs commands for changing the recovery selector valve 10 to the closed state, the bottom-side hydraulic fluid chamber line selector valve 11 to the open state, the rod-side hydraulic fluid chamber line selector valve 12 to the open state, and the discharge selector valve 13 to the closed state, respectively to the first, second, fourth, and third solenoid selector valves 15, 16, 18, and 17. The controller 100 also disables the control signal for the solenoid proportional valve 14 and the electric generator target rotational speed command for the inverter 22. After this step is executed, control returns to the main routine.

In order to decide whether the hydraulic fluid remains under the boosted pressure in the rod-side hydraulic fluid chamber line 40*b* or not, the controller 100 decides whether the differential pressure between the pressure in the rod-side hydraulic fluid chamber 3*ay* of the boom cylinder 3*a* and the pressure in the bottom-side hydraulic fluid chamber 3*ax* thereof exceeds the predetermined differential pressure Pset3 set for changeover or not (step S13). This decision is made in order to discharge any remaining hydraulic fluid after the energy recovery operation. If the differential pressure is higher than the set pressure, then control goes to step S14 in order to discharge any remaining hydraulic fluid. Otherwise, control goes back to step S13.

The controller 100 changes over the discharge selector valve 13 (step S14). Specifically, the controller 100 outputs a changeover command to the third solenoid selector valve 17. The rod-side hydraulic fluid chamber line 40*b* and the tank 6A are now brought into fluid communication with each other, allowing any remaining hydraulic fluid to be discharged into the tank 6A. After this step is executed, control returns to the main routine.

With the hydraulic fluid energy recovery apparatus for the work machine according to the first embodiment of the present invention, as described above, inasmuch as the pressure of the return hydraulic fluid to be discharged from the hydraulic cylinder 3*a* is boosted in the hydraulic fluid chamber while the speed of the piston rod in the hydraulic cylinder 3*a* is being controlled, reducing the flow rate of the return hydraulic pressure flowing into the hydraulic fluid energy recovery apparatus, the hydraulic fluid energy recovery apparatus can be reduced in size without reducing the recovered energy. As a result, the work machine is allowed to ensure operability equivalent to standard construction machines, and the efficiency with which to recover energy can be increased.

With the hydraulic fluid energy recovery apparatus for the work machine according to the first embodiment of the present invention, furthermore, in the transient state upon the recovery of energy, the pressure in the bottom-side hydraulic fluid chamber 3*ax* is prevented from increasing more than necessary, and the speed of the piston rod can be controlled at a target level, so that the hydraulic pressure in the rod-side hydraulic fluid chamber 3*ay* and the hydraulic pressure in the bottom-side hydraulic fluid chamber 3*ax* can be boosted while keeping the piston rod in good behavior. As a result, the work machine is allowed to ensure operability equivalent to standard construction machines, and the efficiency with which to recover energy can be increased.

Embodiment 2

Figure 7:
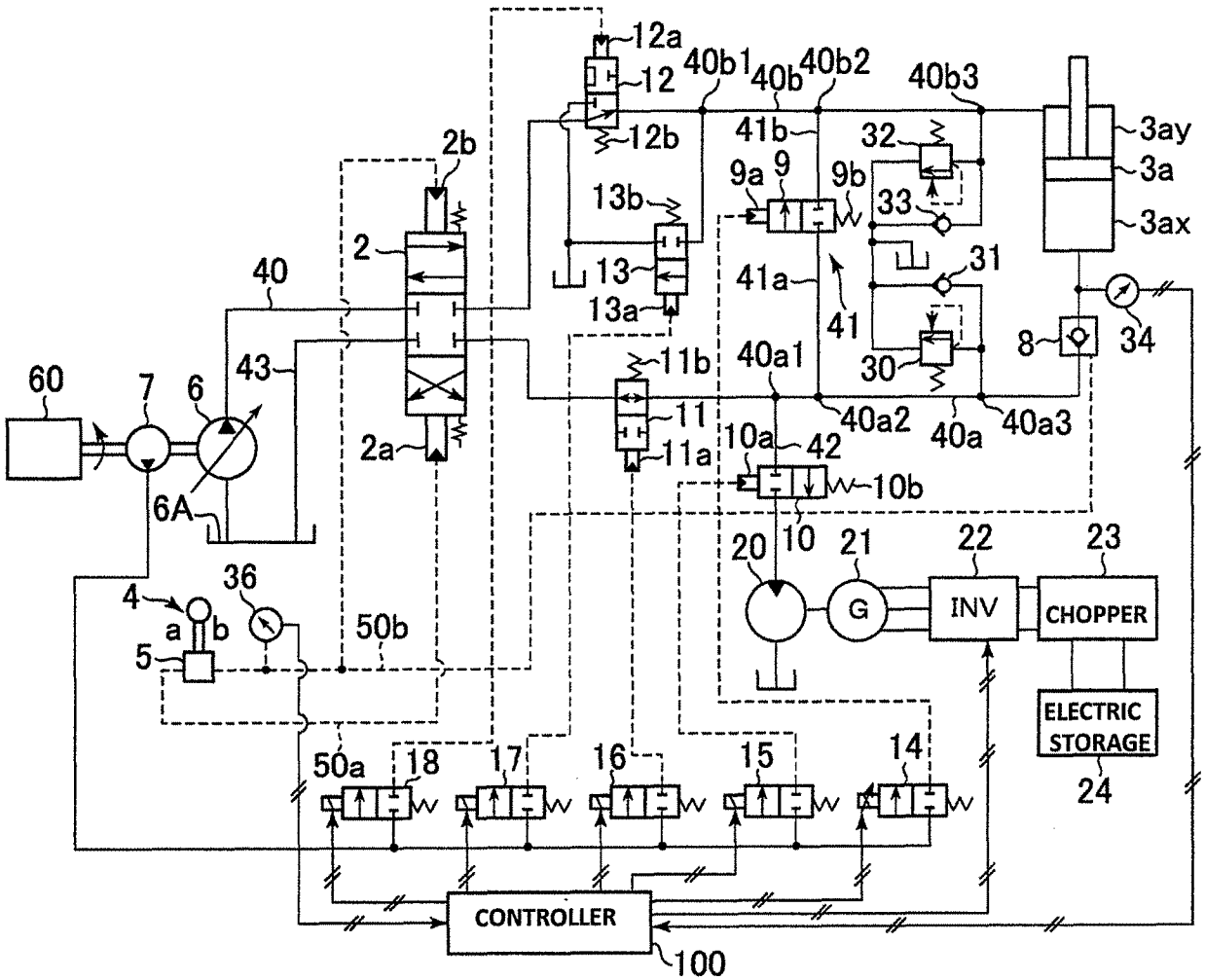
FIG. 7 is a schematic diagram of a control system of a hydraulic fluid energy recovery apparatus for a work machine according to a second embodiment of the present invention.
Figure 8:
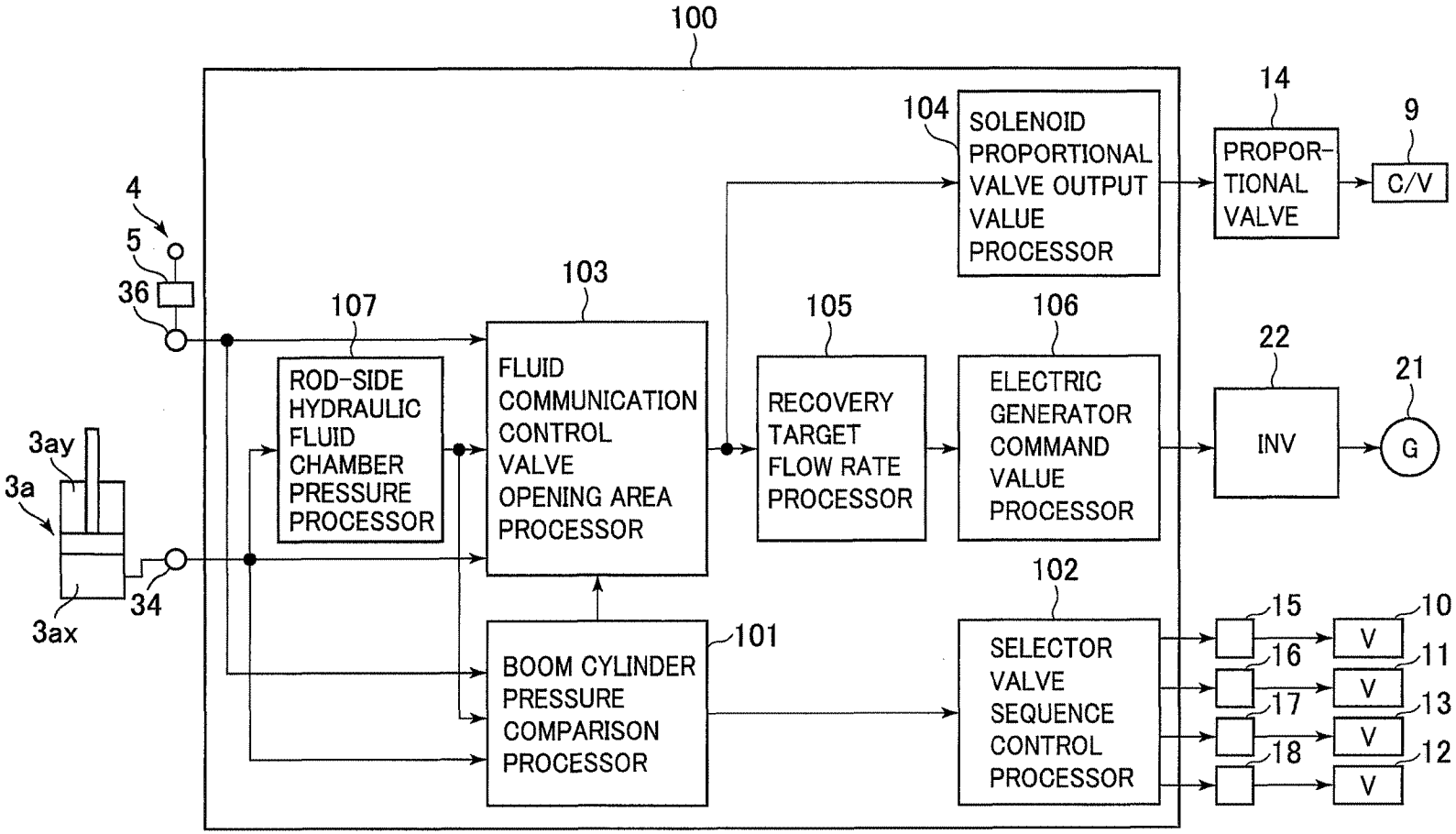
FIG. 8 is a block diagram of a controller of the hydraulic fluid energy recovery apparatus for the work machine according to the second embodiment of the present invention.

A hydraulic fluid energy recovery apparatus for a work machine according to a second embodiment of the present invention will be described below with reference to the drawings. FIG. 7 is a schematic diagram of a control system of the hydraulic fluid energy recovery apparatus for the work machine according to the second embodiment of the present invention, and FIG. 8 is a block diagram of a controller of the hydraulic fluid energy recovery apparatus for the work machine according to the second embodiment of the present invention. In FIGS. 7 and 8, those reference characters which are identical to those shown in FIGS. 1 and 6 denote identical parts, and will not be described in detail below.

The hydraulic fluid energy recovery apparatus for the work machine according to the second embodiment of the present invention shown in FIGS. 7 and 8 is essentially made up of a hydraulic pressure source and a work machine, etc. which are similar to those according to the first embodiment, but is different therefrom as follows: According to the present embodiment, the pressure sensor 35 for measuring the pressure of the hydraulic fluid in the rod-side hydraulic fluid chamber 3*ay* of the boom cylinder 3*a* is dispensed with, and a rod-side hydraulic fluid chamber pressure processor 107 is provided for calculating the pressure in the rod-side hydraulic fluid chamber 3*ay* from the pressure in the bottom-side hydraulic fluid chamber 3*ax*.

In FIG. 8, the rod-side hydraulic fluid chamber pressure processor 107 is supplied with the data on the pressure, detected by the pressure sensor 34, in the bottom-side hydraulic fluid chamber 3*ax* of the boom cylinder 3*a*, and calculates the rod-side hydraulic fluid chamber pressure. Specifically, the rod-side hydraulic fluid chamber pressure processor 107 calculates and estimates the rod-side hydraulic fluid chamber pressure from the pressure in the bottom-side hydraulic fluid chamber 3*ax* while the piston rod is operating at a steady speed, and calculates the following equations (15) through (17):

$$M=Pb'\cdot Ab \tag{15}$$

where M represents the load on the boom cylinder 3*a* including a front working device, Pb' the pressure in the bottom-side hydraulic fluid chamber 3*ax* of the boom cylinder 3*a* at the time the fluid communication control valve 9 is closed, and Ab the area of the piston in the bottom-side hydraulic fluid chamber 3*ax* of the boom cylinder 3*a*. It is assumed that the pressure in the rod-side hydraulic fluid chamber 3*ay* of the boom cylinder 3*a* at the time the fluid communication control valve 9 is closed is 0.

The pressure Pr in the rod-side hydraulic fluid chamber at the time the fluid communication control valve 9 is open is calculated according to the equation (16):

$$Pr=(Pb\cdot Ab-M)/Ar \tag{16}$$

where Pb represents the pressure in the bottom-side hydraulic fluid chamber 3*ax* of the boom cylinder 3*a*, and Ar the area of the piston in the rod-side hydraulic fluid chamber 3*ay* of the boom cylinder 3*a*.

The equation (15) is substituted in the equation (16), which is solved for the pressure Pr according to the equation (17).

$$Pr=Ab/Ar-(Pb-Pb') \tag{17}$$

The pressure in the rod-side hydraulic fluid chamber 3*ay* can be calculated and estimated from the pressure in the bottom-side hydraulic fluid chamber 3*ax* according to the equation (17).

The rod-side hydraulic fluid chamber pressure processor 107 outputs the pressure in the rod-side hydraulic fluid chamber 3*ay* to the boom cylinder pressure comparison processor 101 and the fluid communication control valve opening area processor 103.

The hydraulic fluid energy recovery apparatus for the work machine according to the second embodiment of the present invention as described above is capable of offering the same advantages as those of the first embodiment.

According to the present embodiment, the cost is reduced because the pressure sensor 35 for measuring the pressure of the hydraulic fluid in the rod-side hydraulic fluid chamber 3*ay* of the boom cylinder 3*a* is dispensed with.

DESCRIPTION OF REFERENCE CHARACTERS

1: Hydraulic excavator
1*a*: Boom
2: Control valve
2*a*: Pilot pressure bearing member
2*b*: Pilot pressure bearing member
3*a*: Boom cylinder
3*ax*: Bottom-side hydraulic fluid chamber
3*ay*: Rod-side hydraulic fluid chamber
4: Operating device
5: Control valve
6: Hydraulic pump
6A: Tank
7: Pilot hydraulic pump
8: Pilot check valve
9: Fluid communication control valve
10: Recovery selector valve
11: Bottom-side hydraulic fluid chamber line selector valve
12: Rod-side hydraulic fluid chamber line selector valve
13: Discharge selector valve (discharge valve)
14: Solenoid proportional valve
15: First solenoid selector valve
16: Second solenoid selector valve
17: Third solenoid selector valve
18: Fourth solenoid selector valve
20: Hydraulic motor
21: Electric generator
22: Inverter
23: Chopper
24: Electric storage device
30: First overload relief valve
31: First makeup valve
32: Second overload relief valve
33: Second makeup valve
34: Pressure sensor (first pressure detecting means)
35: Pressure sensor (second pressure detecting means)
36: Pressure sensor (pilot pressure detecting means)
40: Line
40*a*: Bottom-side hydraulic fluid chamber line
40*b*: Rod-side hydraulic fluid chamber line
41: Fluid communication line
41*a*: Bottom-side hydraulic fluid chamber fluid communication line
41*b*: Rod-side hydraulic fluid chamber fluid communication line
42: Recovery line
43: Return line
50*a*: Pilot hydraulic fluid line
50*b*: Pilot hydraulic fluid line
60: Engine
100: Controller

The invention claimed is:

1. A hydraulic fluid energy recovery apparatus for a work machine including a hydraulic pump, a hydraulic cylinder for actuating a working assembly, an operating device for operating the hydraulic cylinder, and a hydraulic motor for recovering a return hydraulic fluid from the hydraulic cylinder, comprising:

a fluid communication line for holding a bottom-side hydraulic fluid chamber and a rod-side hydraulic fluid chamber of the hydraulic cylinder in fluid communication with each other;

a fluid communication valve connected to the fluid communication line, for adjusting the pressure and/or flow rate of a hydraulic fluid passing through the fluid communication line in a manner that allows for adjustment of a degree of opening of the fluid communication valve;

a first pressure sensor for detecting a signal indicative of pressure at the bottom-side hydraulic fluid chamber of the hydraulic cylinder;

a second pressure sensor for detecting a signal indicative of pressure at the rod-side hydraulic fluid chamber of the hydraulic cylinder;

a pilot pressure sensor for detecting an amount of operation of the operating device; and a control device configured to:

capture the signal indicative of pressure at the bottom-side hydraulic fluid chamber of the hydraulic cylinder detected by the first pressure sensor, and the amount of operation of the operating device detected by the pilot pressure sensor, calculate the speed of a piston rod of the hydraulic cylinder, and control the fluid communication valve responsive to the speed of the piston rod, control the fluid communication valve such that an opening degree thereof decreases if a differential pressure exceeds a predetermined set pressure, the differential pressure measured between the pressure in the bottom-side hydraulic fluid chamber of the hydraulic cylinder detected by the first pressure sensor, and the pressure in the rod-side hydraulic fluid chamber of the hydraulic cylinder detected by the second pressure sensor, and control the fluid communication valve such that the opening degree thereof is full open if the differential pressure between the pressure in the bottom-side hydraulic fluid chamber of the hydraulic cylinder and the pressure in the rod-side hydraulic fluid chamber of the hydraulic cylinder is equal to or lower than the predetermined set pressure.

2. The hydraulic fluid energy recovery apparatus for a work machine according to claim 1, wherein the control device controls the fluid communication valve so that the flow rate of the hydraulic fluid flowing in from the bottom-side hydraulic fluid chamber of the hydraulic cylinder to the rod-side hydraulic fluid chamber thereof is greater than a flow rate of a hydraulic fluid which is drawn into the rod-side hydraulic fluid chamber as the volume of the rod-side hydraulic fluid chamber, which is calculated from the speed of the piston rod, increases.

3. The hydraulic fluid energy recovery apparatus for a work machine according to claim 1, further comprising:

a pressure control valve which is opened to discharge the hydraulic fluid into a tank if the pressure of the hydraulic fluid in the hydraulic cylinder increases to a value equal to or higher than a relief pressure thereof;

wherein the control device continues a control to close the fluid communication valve if while the fluid communication valve is being closed, a differential pressure exceeds a predetermined set pressure, the differential pressure measured between the pressure in the bottom-side hydraulic fluid chamber of the hydraulic cylinder detected by the first pressure sensor, and the relief pressure.

4. The hydraulic fluid energy recovery apparatus for a work machine according to claim 1, further comprising:

a control valve controlled by the operating device, for changing over and supplying the hydraulic fluid from the hydraulic pump to the hydraulic cylinder; and a discharge valve disposed between the hydraulic cylinder and the control valve, for bringing the hydraulic fluid from the rod-side hydraulic fluid chamber of the hydraulic cylinder into a tank.

5. A hydraulic fluid energy recovery apparatus for a work machine including a hydraulic pump, a hydraulic cylinder for actuating a working assembly, an operating device for operating the hydraulic cylinder, and a hydraulic motor for recovering a return hydraulic fluid from the hydraulic cylinder, comprising:

a fluid communication line for holding a bottom-side hydraulic fluid chamber and a rod-side hydraulic fluid chamber of the hydraulic cylinder in fluid communication with each other;

a fluid communication valve connected to the fluid communication line, for adjusting the pressure and/or flow rate of a hydraulic fluid passing through the fluid communication line in a manner that allows for adjustment of a degree of opening of the fluid communication valve;

a first pressure sensor for detecting a signal indicative of pressure at the bottom-side hydraulic fluid chamber of the hydraulic cylinder;

a second pressure sensor for detecting a signal indicative of pressure at the rod-side hydraulic fluid chamber of the hydraulic cylinder;

a pilot pressure sensor for detecting an amount of operation of the operating device; and a control device configured to:

capture the signal indicative of pressure at the bottom-side hydraulic fluid chamber of the hydraulic cylinder detected by the first pressure sensor, and the amount of operation of the operating device detected by the pilot pressure sensor, calculate the speed of a piston rod of the hydraulic cylinder, and control the fluid communication valve responsive to the speed of the piston rod, wherein the hydraulic fluid energy recovery apparatus further comprises:

a pressure control valve which is opened to discharge the hydraulic fluid into a tank if the pressure of the hydraulic fluid in the hydraulic cylinder increases to a value equal to or higher than a relief pressure thereof, and wherein the control device control is further configured to execute a control to close the fluid communication valve if while the fluid communication valve is being open, a differential pressure exceeds a predetermined set pressure, the differential pressure measured between the pressure in the bottom-side hydraulic fluid chamber of the hydraulic cylinder detected by the first pressure sensor, and the relief pressure.

* * * * *